US007232350B1

(12) United States Patent
Krah

(10) Patent No.: US 7,232,350 B1
(45) Date of Patent: Jun. 19, 2007

(54) HUMAN POWERED WATERCRAFT

(76) Inventor: Drew Allen Krah, 20429 Chautauqua Beach Rd. SW., Vashon, WA (US) 98070

( * ) Notice: Subject to any disclaimer, the term of this patent is extended or adjusted under 35 U.S.C. 154(b) by 0 days.

(21) Appl. No.: 11/474,563

(22) Filed: Jun. 26, 2006

(51) Int. Cl.
*B63H 16/18* (2006.01)
*B63H 16/00* (2006.01)

(52) U.S. Cl. ..... 440/35; 440/21

(58) Field of Classification Search ..... 440/13–15, 440/21, 25, 26
See application file for complete search history.

(56) References Cited

U.S. PATENT DOCUMENTS 4,464,126 A * 8/1984 Maisonneuve ..... 440/15
4,968,273 A * 11/1990 Momot ..... 440/14
7,112,108 B2 * 9/2006 McMullen ..... 440/22

* cited by examiner

*Primary Examiner*—Jesús D. Sotelo

(57) ABSTRACT

The watercraft described herein is a surfboard, skim board, dive board, or boat having a propelling fin driven by a standing surfer or boater with an upward and downward stroke which may be used to propel the watercraft by an upward and downward fin motion. The surfboard and dive board in particular are used on water and may be used to ride ocean swells and waves. The surfer or diver stands on the board and moves a vertical handle upwardly and downward. The lower end of this handle is pivotally attached to a parallel bar device having attachment means to the board at a forward end of the parallel bar device and having attachment means to a fin at the aft ward end of the parallel bar device. The fin is generally horizontal and is driven thru the water up and downwardly by the standing user and propels the board forward at higher rates of speed than can be achieved by prone-paddling. The handle, four bar device, and fin may be stowed within the body of the board when in a non-propelling position and so allow the surfer or diver to lie upon and paddle the board in standard surfboard prone paddling fashion while also enabling the board to be ridden as a standard surfboard upon the ocean waves.

16 Claims, 19 Drawing Sheets

HUMAN POWERED WATERCRAFT

BACKGROUND

1. Field of the Invention

Human powered watercraft such as surfboards, skimboards, body boards, boogey-boards, and the like are for thrill seeking wave riders. Unfortunately, in addition to being underpowered due to inefficient harnessing of the human engine many of these products suffer from ungainliness, fragility, difficulty of use, and high cost, limiting their acceptance in the market. Therefore, a new human powered watercraft is needed as is a new human power propulsion system for such craft to enhance oceanic and fresh-water athletic pursuits and reduce the cost and complexities thereof and so make more available to all the joys of the life aquatic.

Within the above field of art, surfing continues to enjoy high popularity but, it is well understood, standard paddling methods (prone and knee-paddling) yield a top speed of at best 5 MPH and that speed only for short durations; in general most surfers cannot paddle for longer than 15 minutes without some rest. What is more, the surfer is unable to propel from a standing position and is also statically unstable while standing upon an unmoving surfboard or other water board. While in conditions of large surf, intrepid surfers attempting to paddle out often spend all of their physical reserves trying to make headway against seemingly endless wave trains and white water combers. The surfer that does make it out to the line-up will be depleted and need rest. Only then will he or she be able to summon the arm power needed to pull into a large breaking wave. Unfortunately, the surfer so fatigued is more likely to make costly errors, often endangering him self and other surfers nearby. Consequently, a new means of propelling the surfer which harnesses more power from the human engine will make easier the catching of waves, the transit from beach to wave and will not only enable more waves to be ridden but will enable the use of the surfboard so outfitted as a transportation vehicle from break-to-break and from beach-to-beach at speeds approaching and beyond 10 MPH. A new human powered watercraft and propulsion system will be of particular interest to life guards, divers, surfers, body-boarders, and skim-boarders.

2. Description of the Prior Art

Maisonneuve, U.S. Pat. No. 4,464,126, propels a surfboard by thrusting a lever forward and aft from a sitting position to drive a lower fin up and down. The system does not allow the surfer to move about the surfboard and the lower keel structure causes yaw instability with forward motion.

Chen, U.S. Pat. No. 6,468,118 propels a surfboard thru two foot treadles with an up and down leg motion deflecting separate fins. This system attaches the user to the board which can be dangerous when the board rolls over, somewhat entrapping the user.

Momot, U.S. Pat. No. 4,968,273 propels a surfboard with a single treadle driven fin using weight shifting forward and aft to propel the board. The system has a great deal of drag surface offered to the water, does not stow and so is constantly dragging down board speed.

Domancic, U.S. Pat. No. 5,549,491 propels a surfboard or boat by a single treadle driving two fins by a lateral, side to side weight shift. This motion is particularly destabilizing to a surfboard rider as the board is narrow and least stable laterally.

Malm, U.S. Pat. No. 3,377,977 propels a surfboard by a sculling-sweeping motion of a centrally pivoted oar. The lateral side to side motion of this system destabilizes the surfboard.

Ueno, U.S. Pat. No. 4,936,802 propels a surfboard by a single foot treadle driving a vertical fin to sweep laterally back and forth. The fin motion causes the boat or board to slough sideward without the stabilizing presence of a keel.

Ketterman, U.S. Pat. No. 6,022,249 propels a kayak via foot treadles that drive two flexible fins in opposing directions about the keel of the boat. The system is heavy and complex while also being subject to damage during beaching of the vessel as the fins are most exposed below the keel and users frequently forget to stow the system.

Puzey U.S. Pat. No. 6,099,369 propels a tricycle hydrofoil by a bounding up and down motion of the user. The system suffers from the inability to start from the water and is unstable in yaw when in following seas.

Heywood U.S. Pat. No. 5,127,855 propels a boat from a bicycle mounted atop the vessel. This and all other bicycle systems suffer from the fatal flaw of needing to entrap the users' feet (clip-in) in order to maximize power output. Being clipped into the propulsion system makes emergency exit from the vessel very difficult and potentially fatal.

Triantaffyllou U.S. Pat. No. 5,740,750 propels a fish-like submersible via arm and leg motion of two tandem divers. Emergency egress is quite difficult since the users are encased within the system. The system is designed for stealth as opposed to recreational surfing.

Shiraki U.S. Pat. No. 5,194,024 propels a surfboard via a pedal-crank propeller system operated by a recumbent seated rider. This and all recumbent systems impede the operators ability to react to perturbing waves by limiting all but the users head from counteraction. As with other pedal and crank systems, the device is most efficient when one is clipped in and as stated previously, this makes emergency egress problematic and potentially fatal.

Gander U.S. Pat. No. 4,304,555 propels a float device by a foot operated bell crank driven fish-fin. Absent a keel, the vehicle is unstable in yaw when propelled thusly.

Gaudin U.S. Pat. No. 4,872,861 propels a surfboard via a hand operated bell crank driven fish fin. The system suffers from lack of power common to all arm powered systems.

Stoms U.S. Pat. No. 621,465 propels a boat via a bicycle system.

Whiting U.S. Pat. No. 2,195,527 is a tri-segmented float propulsion system which suffers from general instability.

Han U.S. Pat. No. 6,033,276 propels a surfboard via a bell crank foot operated fish fin. The system causes the board to yaw during operation.

Merrill U.S. patent Ser. No. 1,186,413 propels a floatation body by foot operated treadle driven propeller and maintains pitch attitude via hand controlled elevator fins. The system suffered from excessive drag caused by the users' legs projecting into the water during propulsion.

Newby U.S. Pat. No. 1,324,687 propels a floatation device via propeller driven by a vertical lever under the forward and aft urging of the user. The system is heavy, underpowered, and unstable in pitch when powered thusly.

Skitsko U.S. Pat. No. 3,718,109 propels a sloughing body by forward aft or lateral body motions. The system is slow due to excessive surface area in the water and is unstable.

Proverbio U.S. Pat. No. 5,816,871 propels similarly to Whiting and suffers according to the same deficiencies.

Cleary 20060042536 attempts to propel and steer a kayak via a strut hydrofoil. The strut hydrofoil is rotate-able about a strut axis which axis is tilt able without constraint within a cone of 15 degrees from normal to the surface of the water This relative freedom from-restraint of the strut hydrofoil system when combined with varying sea conditions often causes even the most experienced user to fall off the vehicle while at the same time causing local structural degradation of the strut and vehicle. Neither the strut nor the hydrofoil are able to be stowed within the body of the kayak and so are subject to impingement and damage by unseen objects in the water primarily and then due to secondary impact by the user. The strut-hydrofoil system described is unsuited to ocean-wave riding vehicles particularly surfboards, skim boards and the like as they operate in shallow waters and are therefore subject to frequent impingement with the submarine terrain.

OBJECTS AND ADVANTAGES

The invention defined herein has substantial advantages over the prior art including but not limited to the following:

1) Higher speeds: In general, vessel speed goes up linearly with the square root of increased power. The present invention by virtue of using the legs, body, and arms for power generation exceeds that power available from the arms only by approximately 6 times. Arm powered paddling of surfboards yields a speed of at best 5 MPH. The square root of 6 being 2.44, times 5 MPH predicts a maximum displacing speed of 12.22 MPH although higher speeds may be obtained due to hydroplaning.

2) Greater duration of power output is possible than with prone or knee paddling techniques on surfboards 3) Greater power yields greater range than is achievable with arm paddling alone.

4) The system enables a surfer to power out thru white-water unlike standard arm paddling which requires the surfer to stop paddling and hold on to surfboard during wash-over by the white-water. FIGS. 2 and 3 illustrate this object and advantage.

5) The greater power of the system and the virtue of the user already being upright enables surfers to catch waves before the critical vertical pitch of the face happens thereby simplifying the task of catching waves.

6) The surfer using the invented system is already standing and so is not required to make the difficult transition from prone/knees to standing in order to catch a wave.

7) The surfer using the present invention is able to maintain standing position on the board even in the absence of any waves since she can maintain stability with forward velocity available by pumping the propulsion system up and down.

8) The user of the invention is constantly moving and no extremity need remain in the water so one is less likely to attract a shark attack.

9) Fitness benefits are derived from the ability to continually work-out rather than laying idle.

10) Like a standard surfboard, it easily carries under one arm. Most human powered watercraft are ungainly and difficult to carry.

11) The invention is substantially lighter than many other human powered water-craft (HPW) and adds little weight above a normal surfboard mass.

12) Substantially less consumer expense than other mechanized HPW is possible due to the simplicity and compact size.

13) The simple direct drive is self-stowing when impinging upon submarine obstacles such as sand bars, thus minimizing breakage.

14) A surfboard powered thusly is far more maneuverable than many other mechanized human powered water craft.

15) The invention is able to power-stop in less than one vehicle length surpassing the performance of other systems.

16) By propelling from a standing position, greater user visibility is achieved than by prone or knee paddled boards or seated propulsion watercraft thereby increasing the safety of the user and those nearby.

17) The user is able to continuously adjust her center of gravity to maintain trim with respect to the boards center of buoyancy and this enables design reductions in size resulting in lower weights and lower manufacturer's costs than other HPW.

18) Reducing population density of surfers in a given locale is enabled because users will be catching waves further out than traditional surfers.

19) Low manufacturers cost relative to larger systems simply by virtue of using less material and processing resources.

20) Greater acceleration and top-end speed will enable surfers to catch very large waves with no difficulty.

21) The system allows the user to continue propelling while riding the wave and so allows the surfer to get a ride on a weak wave where normally a surfer would be unable to continue paddling or riding on a weak and weakening wave.

22) Breaks down, transports, and stores easily like any other surf board and in substantially less space than other HPW.

23) Few parts to break down so low maintenance cost compared to other HPW.

24) Striking a sand bar, the fin-drive self stores, minimizing any potential for damage to the system while at the same time, the handle-bar pivotally stows thus minimizing the potential for injury to the surfer.

25) Multi-modal, can be paddled-and-ridden as a standard surfboard or propelled-and-ridden upright.

26) Transportable on standard surf racks and bike board-racks.

27) While surfing a wave, the handle allows the user to execute maneuvers not normally possible such as inverted re-entry after performing an off-lip maneuver.

SUMMARY OF THE INVENTION

In accordance with the present invention, a human powered watercraft has been designed which is in the form of a board of the shape and dimensions to serve as a surfboard in one embodiment or in the shape and of the dimensions to serve as a skim board in another embodiment, having a graspable down tube projecting through a centralized hole in said board connecting an upper surface to a lower surface of the board, said graspable down tube connecting pivotally to a four bar mechanism made up of two parallel bars residing in said centralized hole connecting said upper surface to said lower surface of said board and residing therein when in a non-propelling position, said parallel bars being oriented substantially along the longitudinal axis of said board and being disposed one above the other and connecting pivotally at respective forward bar ends to said board and connecting pivotally at respective aft bar ends of said bars to a forward end of a propelling fin, said propelling fin oriented substantially horizontally and residing in a recess communicating to said central hole when said fin is in a non-propelling position, making up a board propelling system operable by a standing surf boarder or skim boarder by the downward and upward urging of the boarder of said graspable down tube affecting a propulsive deflection of said fin with each upward and downward down tube stroke action of said boarder, said board propelling system being advantageously storable substantially within the body of said board so allowing said board to be paddled, ridden, and carried in that fashion consistent with historic and traditional methods of paddling, riding, and carrying surfboards, body boards, boogey boards, and skim boards.

The novel design of this invention may be understood by reference to the accompanying drawings in which:

FIGS. 1A, 1B, 1C, 1D, and 1E show an embodiment of the claimed Human Powered Watercraft.

FIGS. 1F and 2 illustrate an embodiment of the claimed Human Powered Watercraft being propelled thru the surf with a vertical upward and downward thrusting stroke of the propulsion system from a standing position. This capability is a particular and unique advantage of the claimed inventive art and will be of particular interest to surfers, divers, and lifeguards.

FIGS. 3, 4, and 5 show a preferred embodiment of the invention as a surfboard and propulsion device. FIG. 3 shows the system in propulsion mode. FIG. 4 shows the system in partial stowage mode. FIG. 5 shows the surfboard with the propulsion system in the fully stowed position and a surfer paddling in the normal mode. The claimed inventive art is unique in its dual modality, that of standing propulsion and also classical paddling propulsion.

FIG. 6, shows a partial cut-away side view of the preferred embodiment of the claimed invention, a surfboard and propulsion system. The simplicity of the device makes it very inexpensive to manufacture and will be of great interest to the makers of surfboards.

FIGS. 7, 7A, and 8 show an alternate embodiment of the claimed invention.

FIGS. 9, 10, and 11 show the claimed invention in a preferred embodiment skim board and propulsion device configuration.

FIGS. 12, 13, and 13A show the claimed invention as an alternative embodiment surfboard and propulsion system.

FIGS. 14, 15, and 16 show an alternate embodiment of the claimed device as a skim board and propulsion system.

FIGS. 17, 18, and 19 show an alternate embodiment of the claimed invention as a surfboard and dagger-board fin-drive.

FIGS. 20, 21, and 22 show the claimed invention as an alternate embodiment skim-board and dagger-board fin-drive.

FIGS. 29, 29A, 29B, and 30 show the claimed invention as an alternate embodiment dagger-board fin-drive device.

Figure 31:
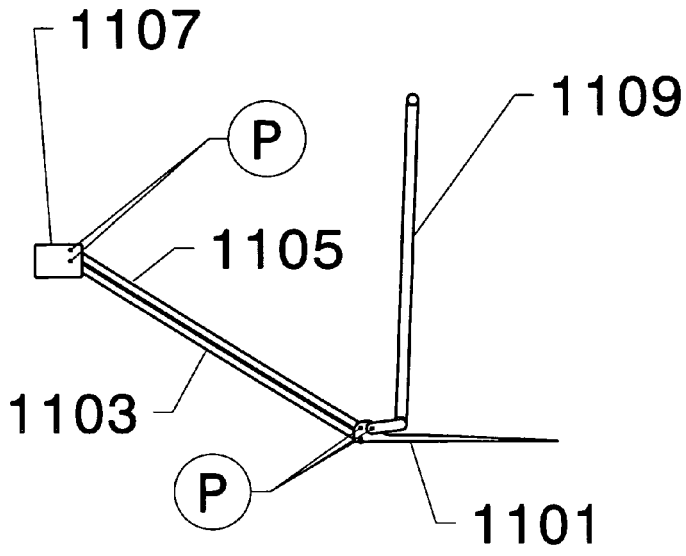
Figure 31A:
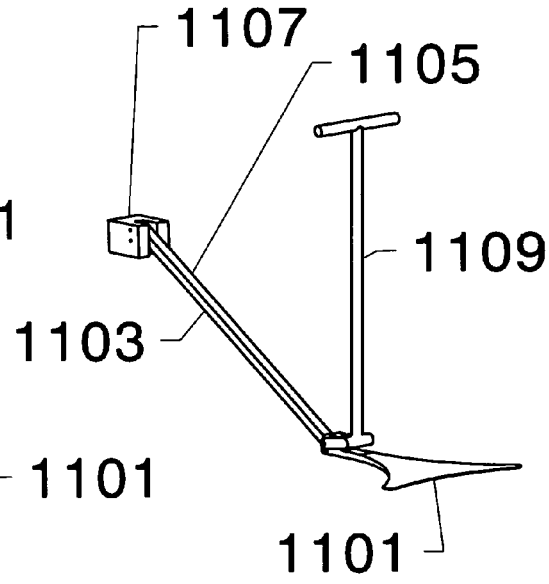
Figure 32:
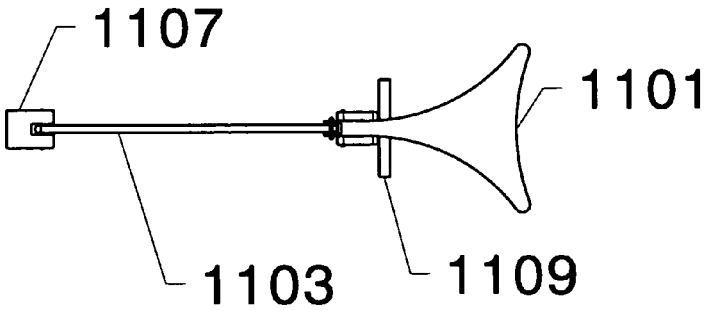

FIGS. 31, 31A and 32 show the claimed invention as an alternate embodiment four-bar fin-drive device with a pivotal actuator down-tube.

FIGS. 33, 33A, 34, and 35 show the claimed invention as an alternate embodiment fin-drive device made up of two parallel bar linkages laterally opposed about a longitudinal centerline of the device and attaching at pivots to the fin, and the pivotal down tube. The two parallel bar linkages are comprised of four bars in total, the bars being attachable to a watercraft at a forward end of each bar.

FIGS. 36, 36A, 37, and 38 show the claimed invention as an alternate embodiment as a skim-board and pivotal-down tube with grasping means.

Figure 39:
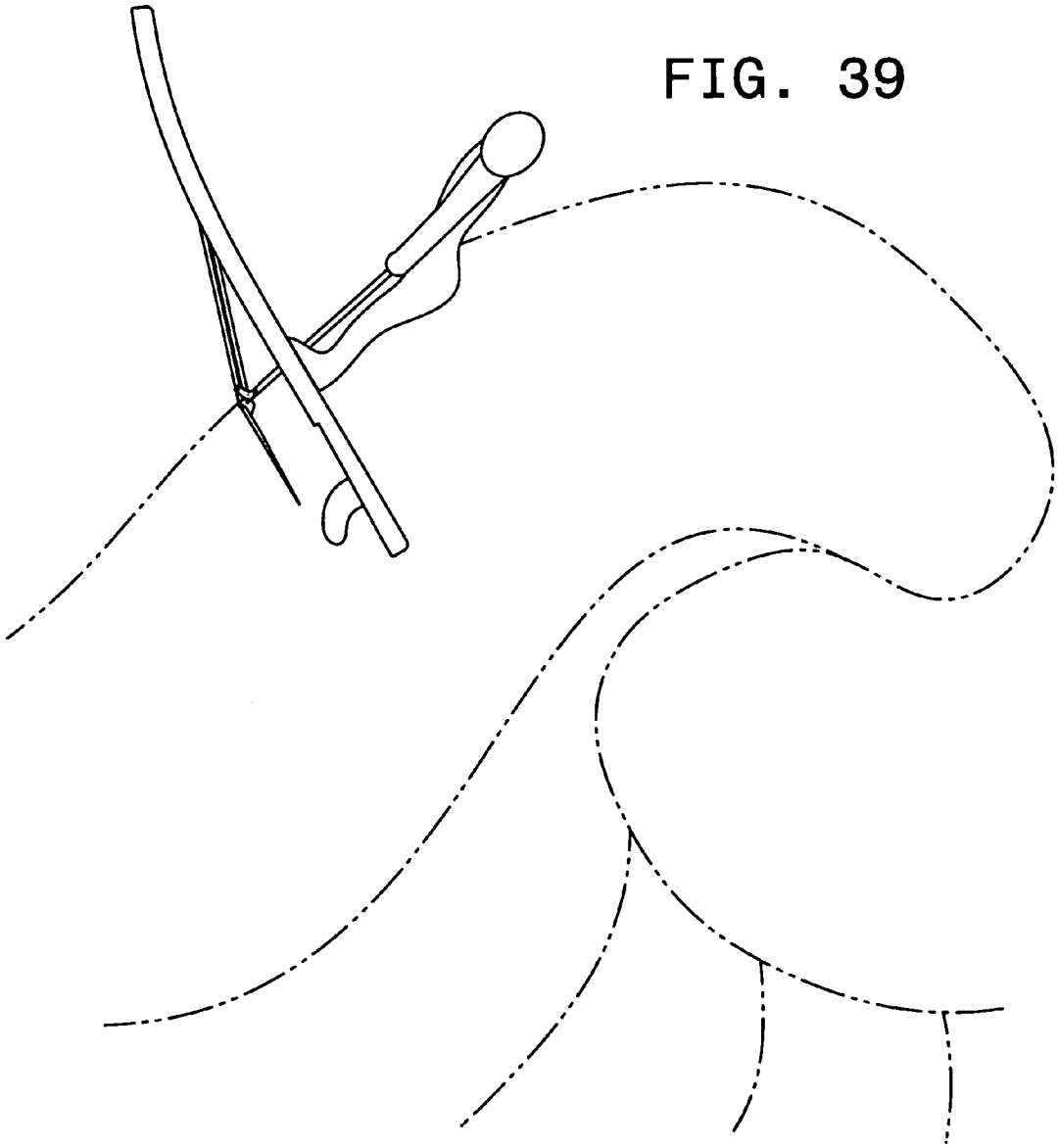

FIG. 39 shows the claimed invention ridden by a surfer having taken flight from a large wave.

In side and isometric view figures, where illustrative, a fastener, pin, or pivot is represented by an encircled P (P).

DETAIL DESCRIPTION OF THE DRAWINGS

Figure 1A:
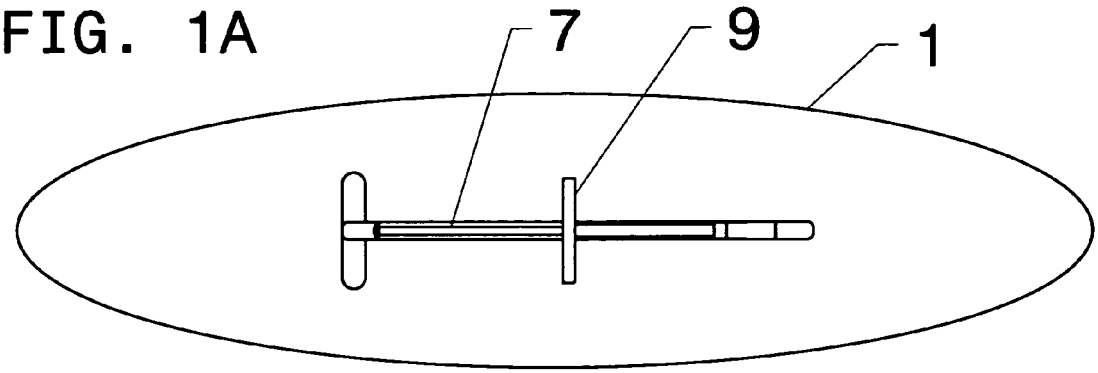
Figure 1B:
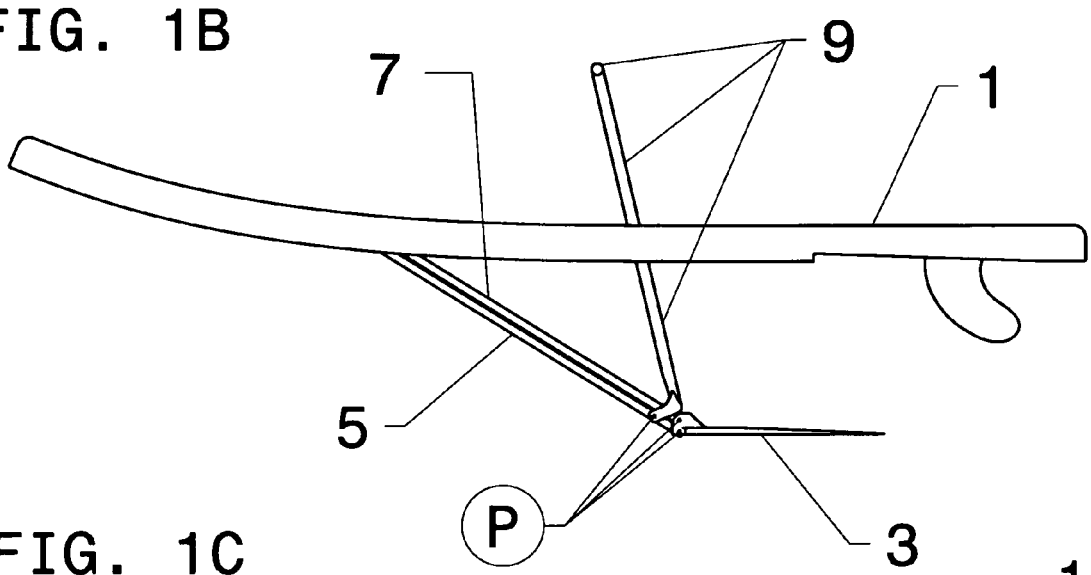
Figure 1C:
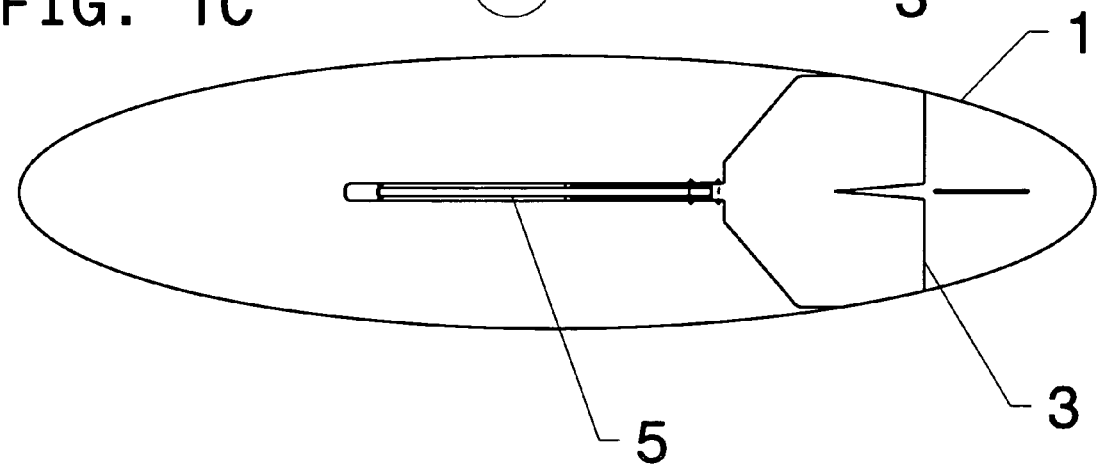

FIGS. 1A, 1B, and 1C, show top, side, and bottom views respectively of a surfboard 1 with an aperture there thru approximately in the center thereof. Below the board 1, a fin 3 is connected via pins, rivets, or other fastening system to a lower parallel bar 5 and its counterpart, an upper parallel bar 7, both of which are attached at their respective forward ends by suitable fasteners to the surfboard 1. Attached to either bar 5 or bar 7 or fin 3 is a pivotal down-tube 9 graspable by the user to urge the system up and down and so effect forward propulsion of the invention.

Figure 1D:
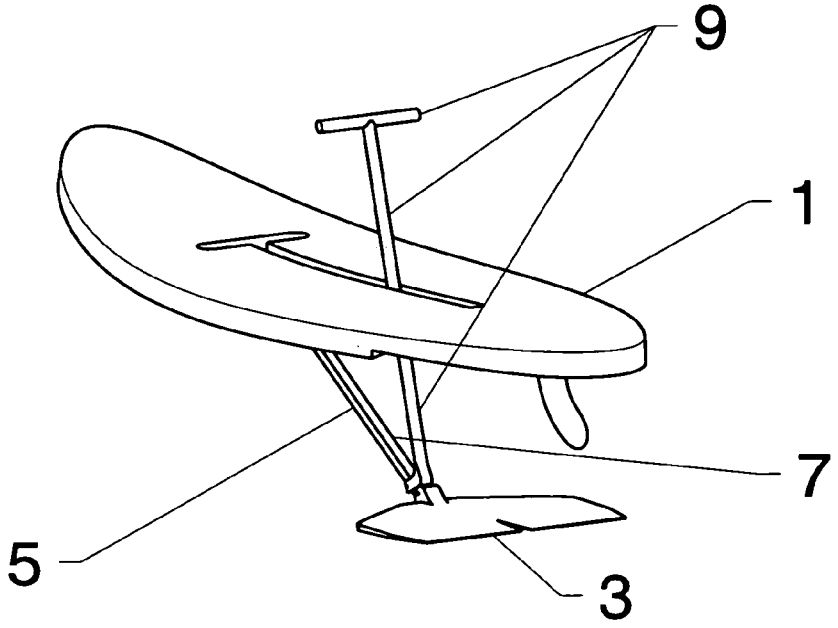
Figure 1E:
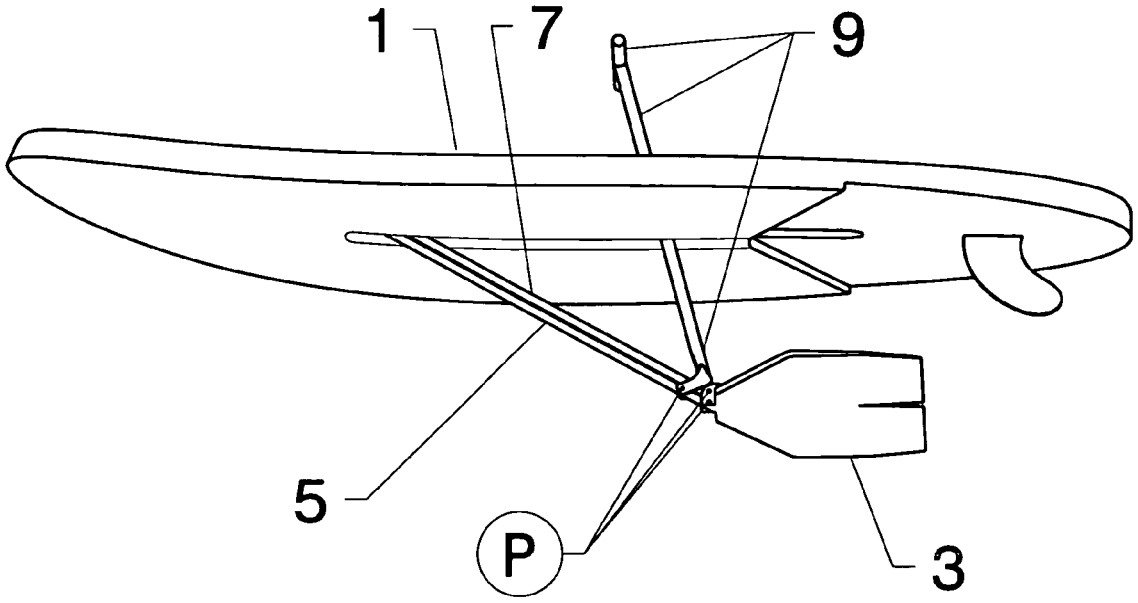

FIGS. 1D and 1E show isometric views of the surfboard 1 with aperture there thru approximately in the center thereof. Below the board 1, the fin 3 is connected via pins, rivets, or other fastening system to the lower parallel bar 5 and its counterpart, upper parallel bar 7, both of which are attached at their respective forward ends by suitable fasteners to the surfboard 1. Attached to either bar 5 or bar 7 or fin 3 is pivotal down-tube 9 graspable by the user to urge the system up and down and so effect forward propulsion of the invention.

Figure 1F:
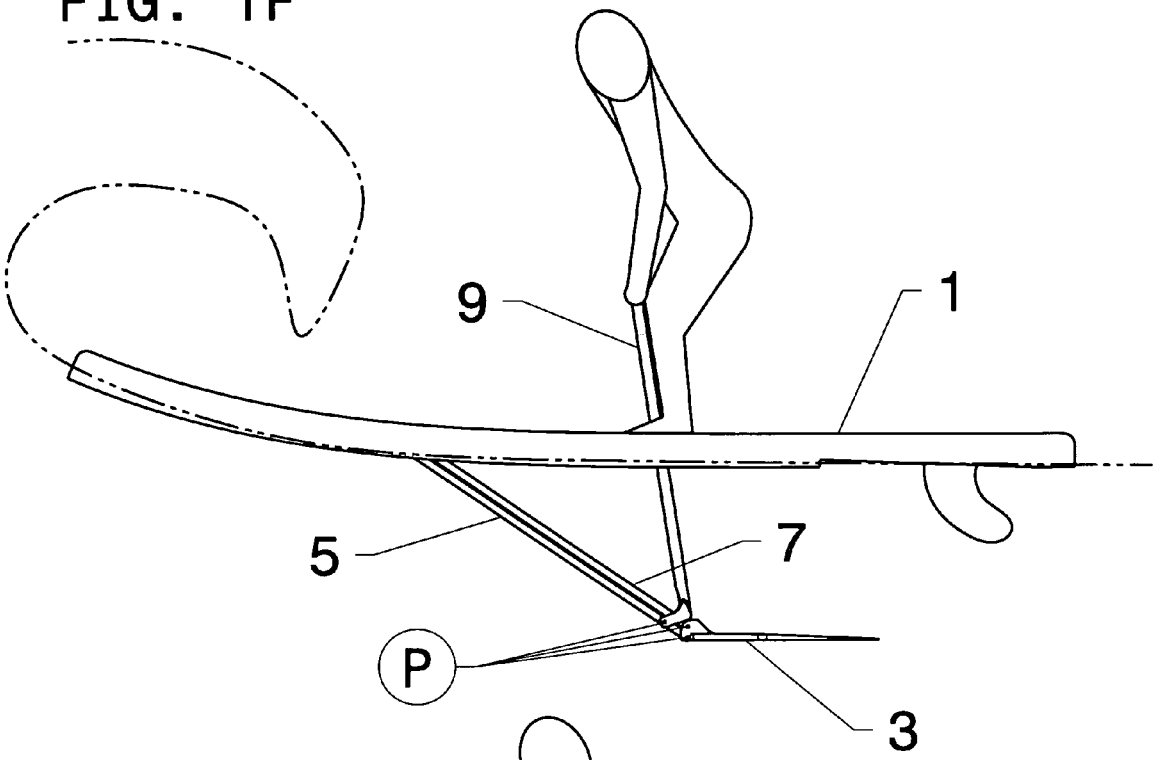

FIG. 1F shows a surfer propelling thru a wave upon the surfboard 1 with an aperture there thru approximately in the center thereof. Below the board 1, the fin 3 is connected via pins, rivets, or other fastening system to the lower parallel bar 5 and its counterpart, the upper parallel bar 7, both of which are attached at their respective forward ends by suitable fasteners to the surfboard 1. Attached to either bar 5 or bar 7 or fin 3 is the pivotal down-tube 9 graspable by the user to urge the system up and down and so effect forward propulsion of the invention. FIG. 1F shows the surfer down-stroking.

Figure 2:
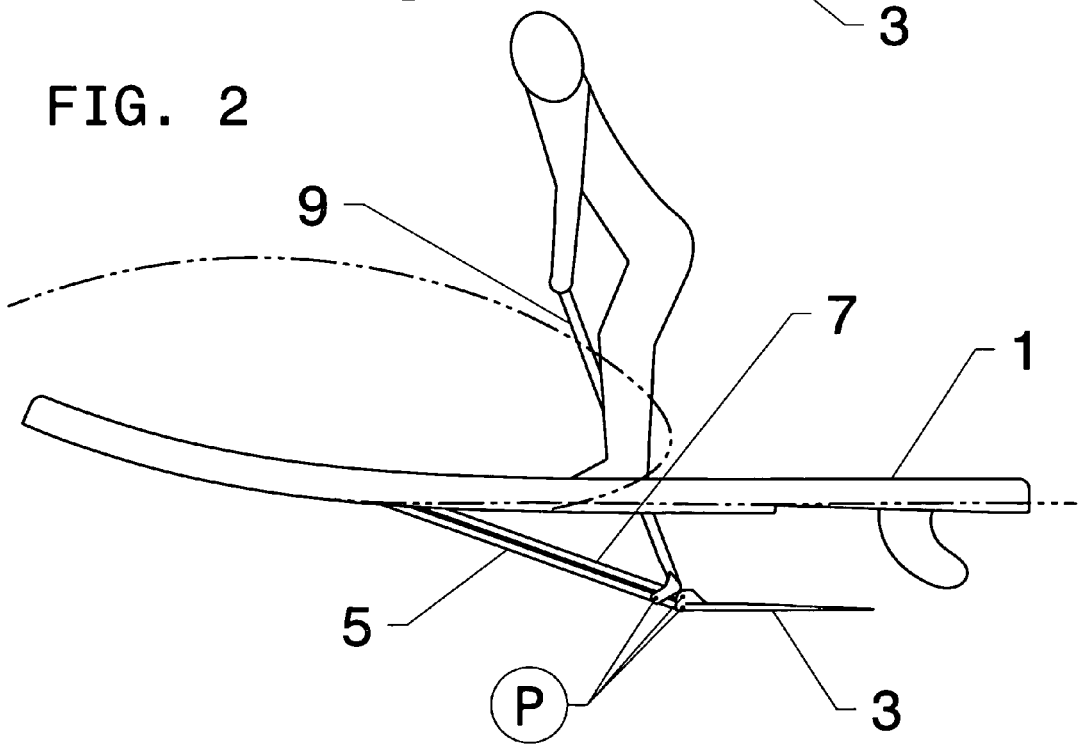

FIG. 2 shows the surfer up-stroking the identical invention as that of FIG. 1F.

Figure 3:
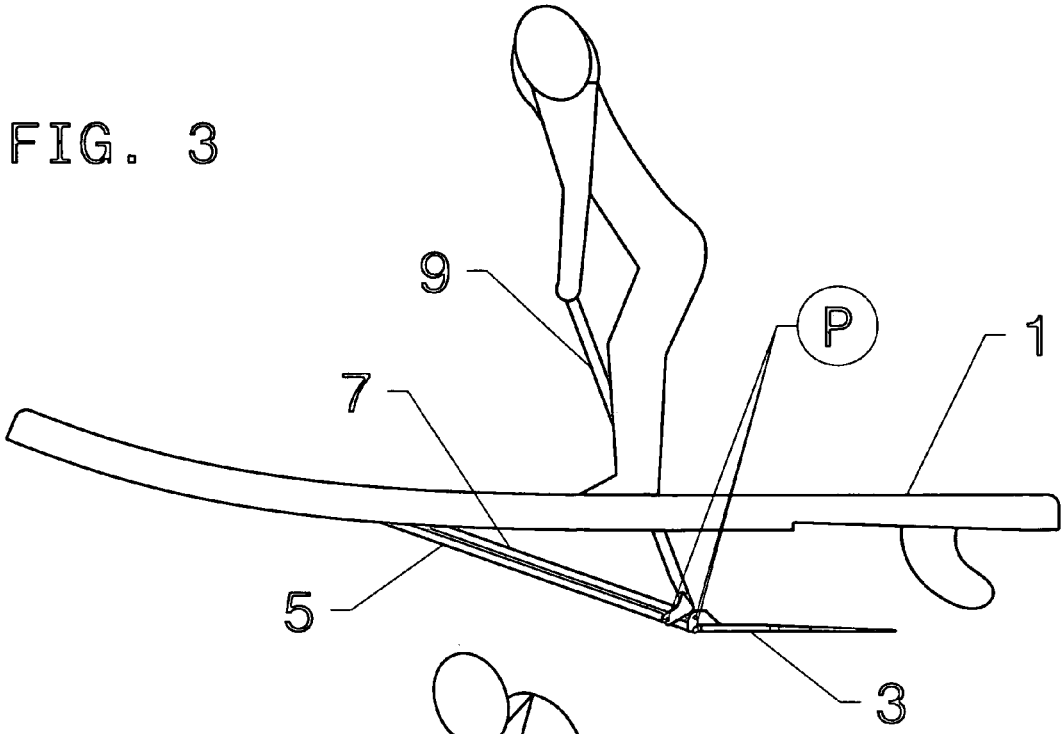
Figure 4:
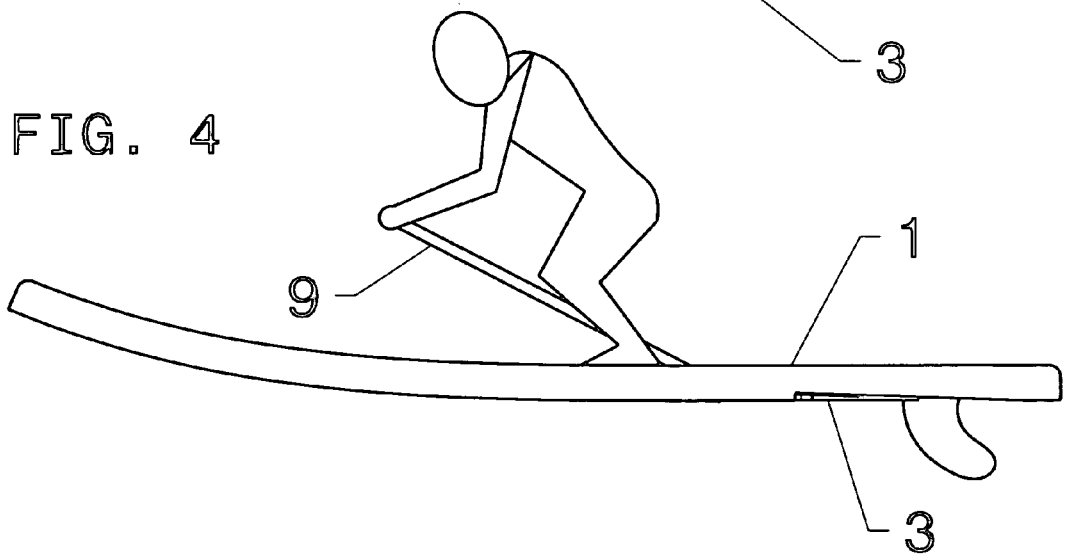
Figure 5:
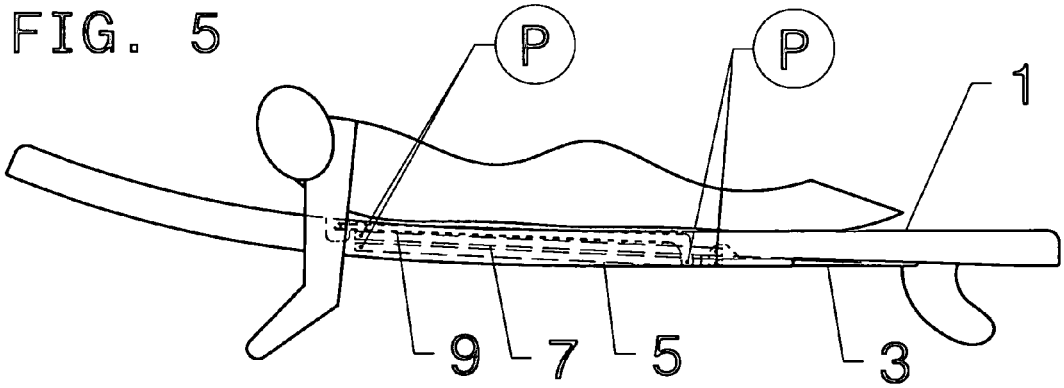

FIGS. 3, 4, and 5 show side views of the invention of FIGS. 1A, 1B, 1C, 1D, 1E, 1F, and FIG. 2. These figures show the dual modality of the invented system.

Figure 6:
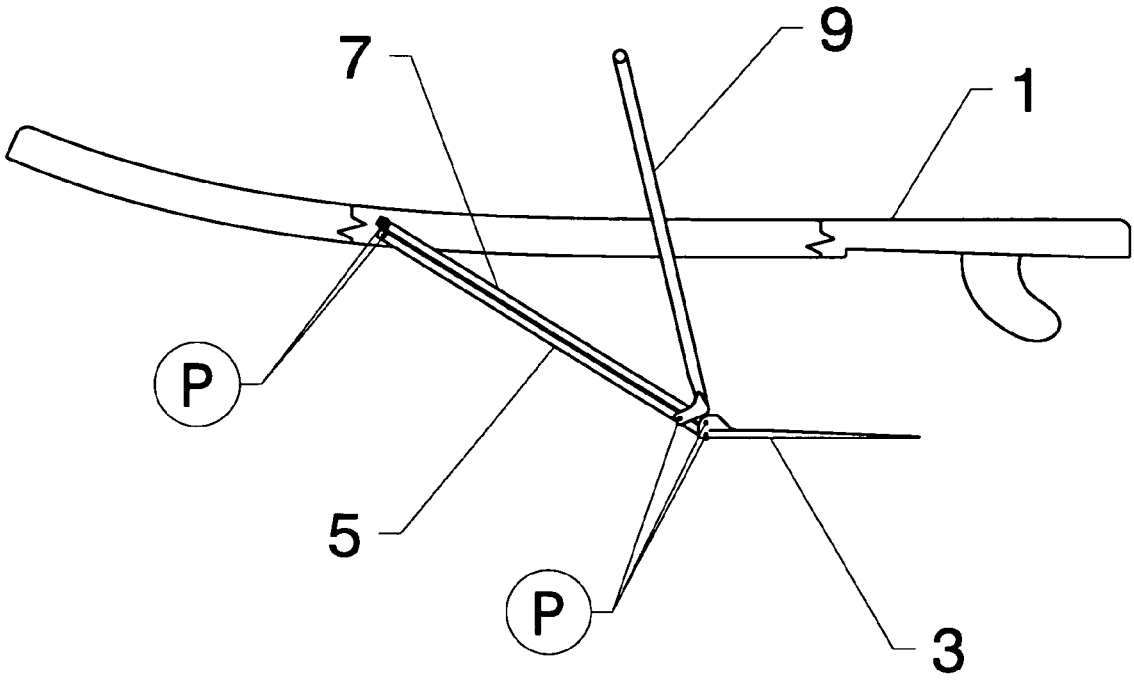

FIG. 6 shows an partial cut-away view of the invention of FIGS. 1A, 1B, 1C, 1D, 1E, 1F, 2, 3, 4, and 5.

Figure 7A:
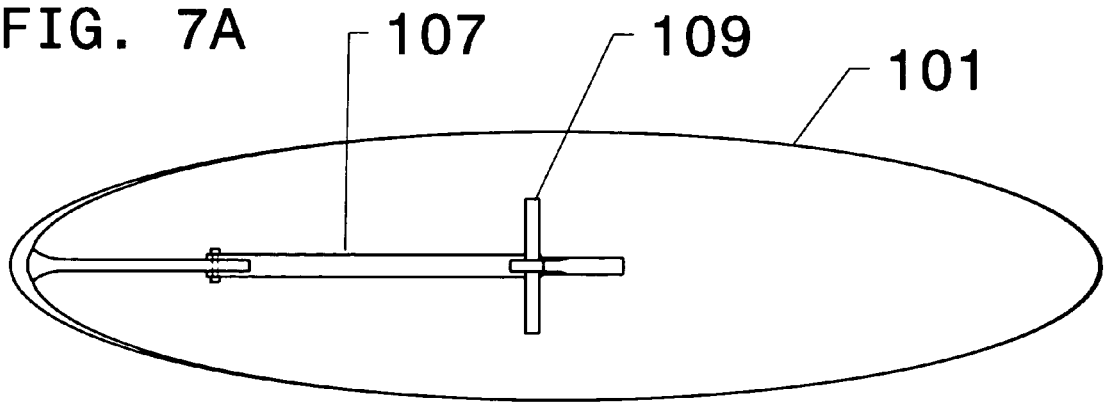
Figure 7:
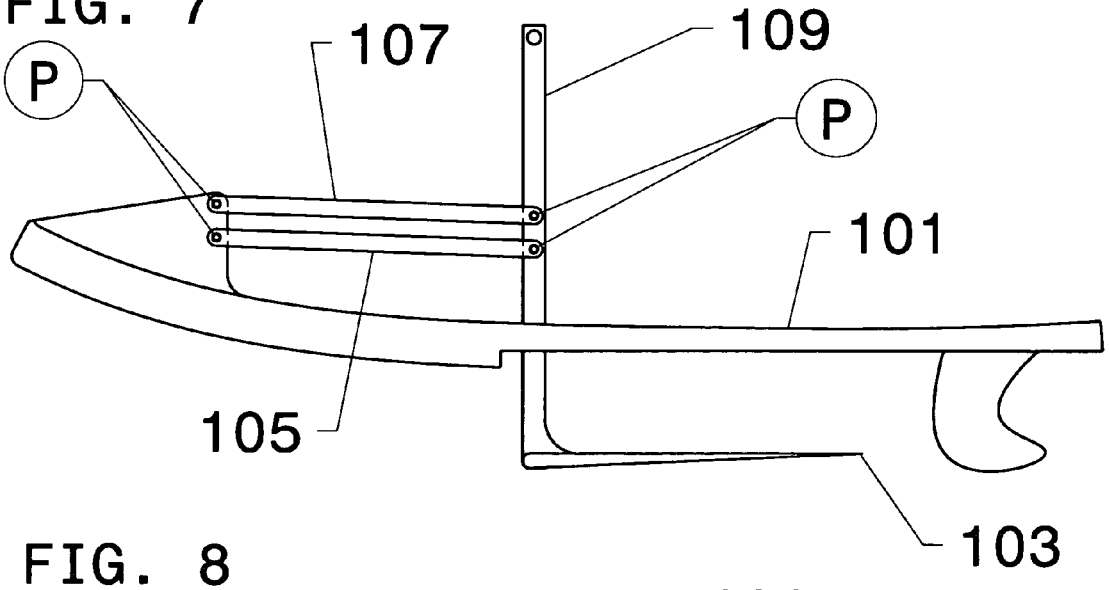

FIGS. 7 and 7A show a surfboard 101 with an aperture connecting the bottom to the upper surface, the aperture located substantially in the center of the surfboard. The bottom of surfboard 101 has a recess for receiving fin 103. Fin 103 is fixedly attached to down tube 109. Down tube 109 is attached to two parallel bars 105 and 107 at their aft ends. Parallel bars 105 and 107 are attached to surfboard 101 at their forward ends at the forward end of surfboard 101. Down tube 109 is graspable and may be urged up and down with thru the aperture of surfboard 101 and may have a handle for grasping by a user. The attachments may be pins, nut-and-bolts, lynch-pins or other means allowing surfboard 101, down tube 109, parallel bars 105 and 107 to act as a four-bar mechanism at the urging of the user, up and down so deflecting fin 103 to propel the invention thru the water.

Figure 8:
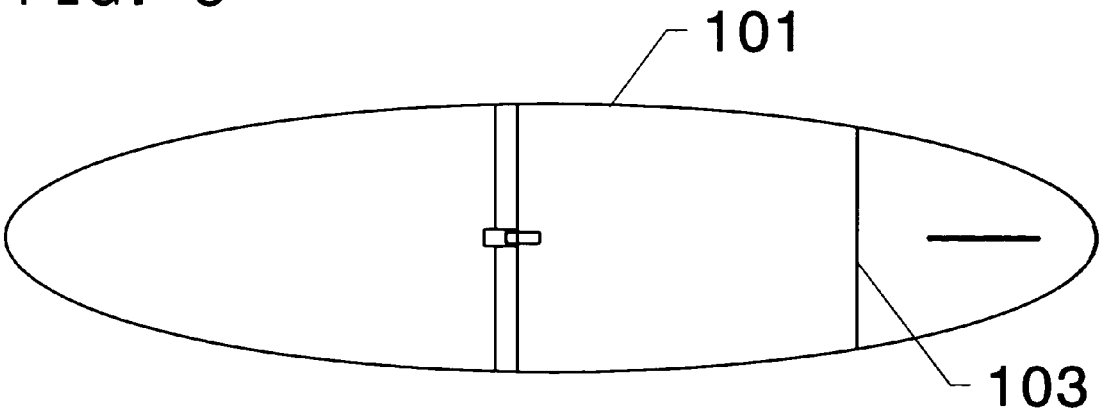

FIG. 8 shows a bottom view of the surfboard 101 of FIGS. 7 and 7A and the fin 103.

Figure 9:
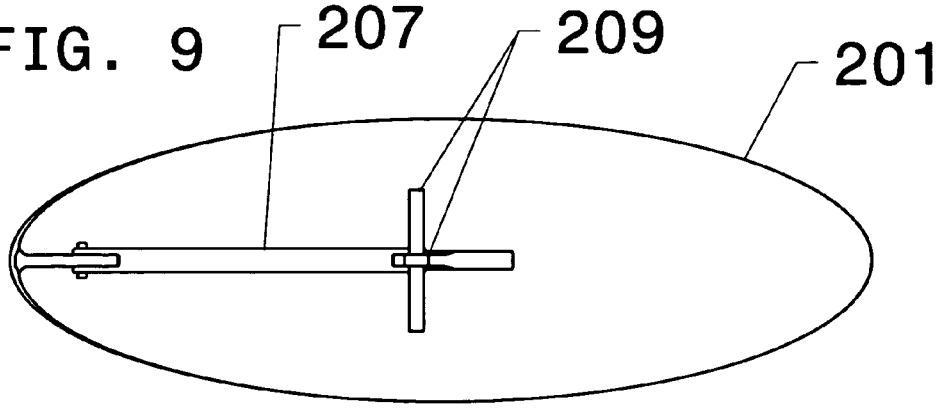

FIG. 9 shows a skim board 201 with an aperture connecting the bottom to the upper surface, the aperture located substantially in the center of the skim board the bottom of skim board 201 has e recess for receiving fin 203. Fin 203 is attached to down tube 209. Down tube 209 is attached to two parallel bars 205 and 207 at their aft ends. Parallel bars 205 and 207 are attached to skim board 201 at their forward ends at the forward end of skim board 201. Down tube 209 is graspable and may be urged up and down thru the aperture of skim board 201 and may have a handle for grasping by a user. The attachments may be pins, nut-and-bolts, lynch-pins or other means allowing skim board 201, down tube 209, parallel bars 205 and 207 to act as a four-bar mechanism at the urging of the user, up and down so deflecting fin 203 to propel the invention thru the water.

Figure 10:
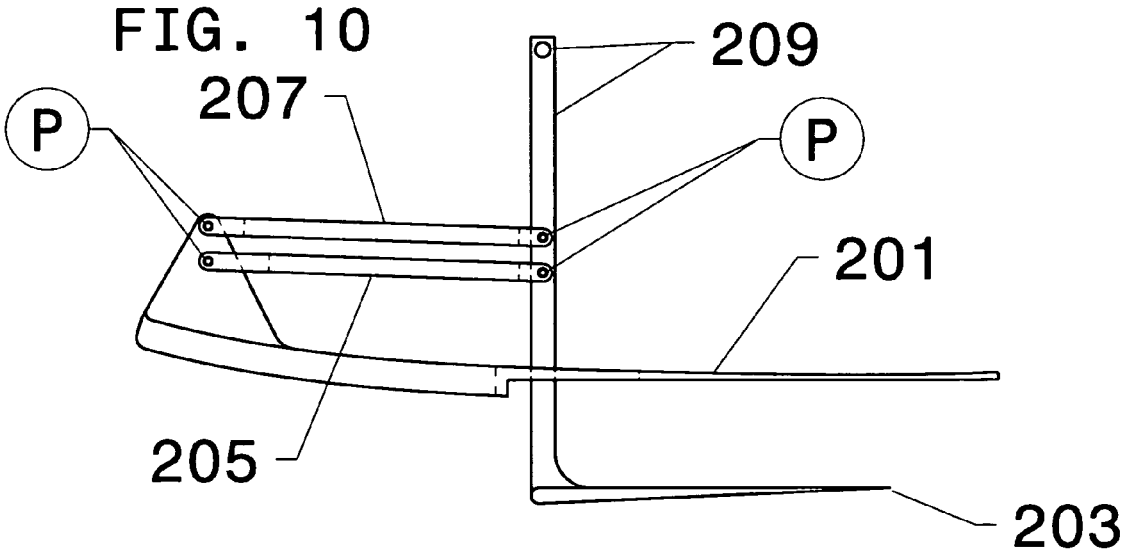

FIG. 10 shows a side view of the device of FIG. 9 the skim-board 201 has a recess in the underside to receive the fin 203 when the fin 203 is in a non-propelling position, the fin 203 is attached to the down tube 209, the down tube 209 is attached to parallel bars 205 and 207 at the aft ends of 205 and 207, parallel bars 205 and 207 are attached at their forward ends to skim board 201. Attachments are standard nut and bolt fasteners or pins such that the device acts as a four bar mechanism at the up and down urging of the user and so deflects fin 203 in the water propelling the device.

Figure 11:
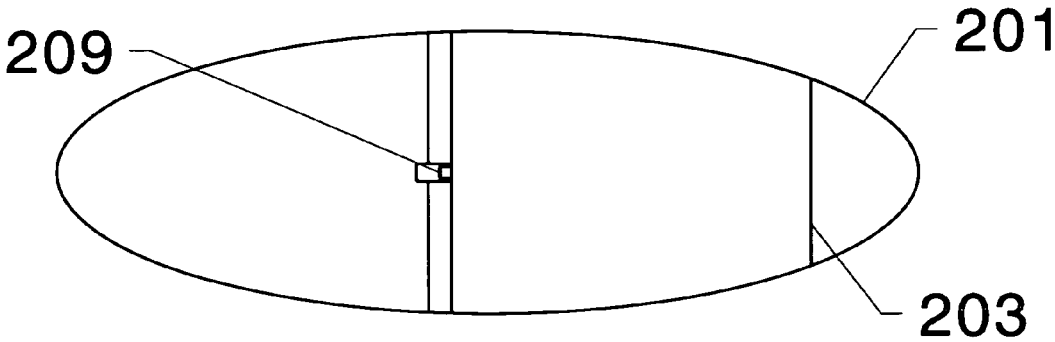

FIG. 11 shows a bottom view of the device of FIGS. 9 and 10, the fin 203 is shaped in the outline of the skim board 201.

Figure 12:
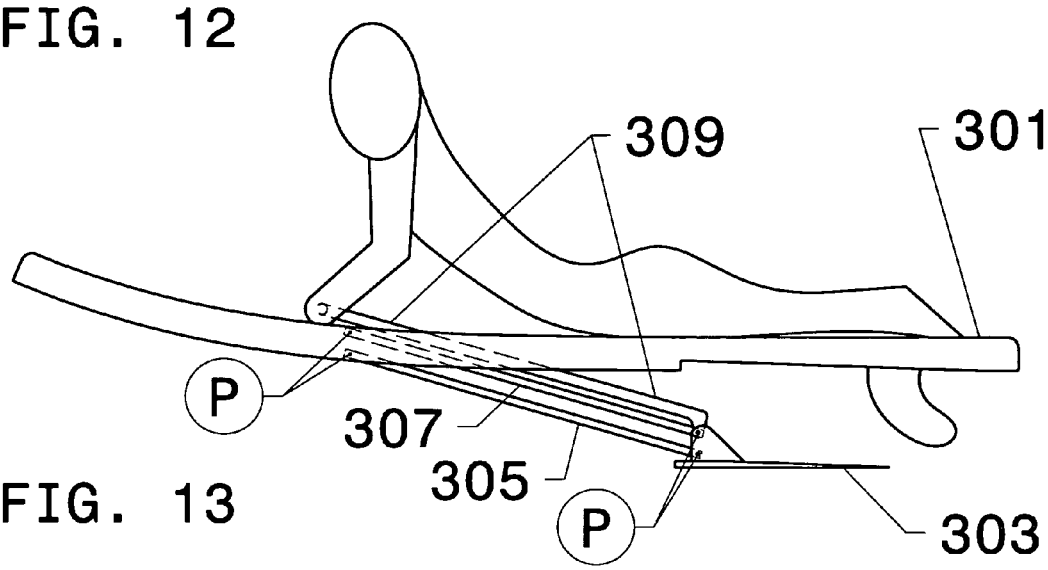

FIG. 12 shows a surfboard 301 with an aperture in the center thereof connecting the bottom surface to the upper surface of the surfboard, said aperture housing a graspable down tube 309, down tube 309 being pivotally connected to a fin 303, said fin 303 is pivotally connected to two sets of parallel bars 305 and 307 disposed distally about the longitudinal centerline of the surfboard 301 and 311 and 313 disposed distally about the centerline of the surfboard 301 in an opposite position from 305 and 307, said two sets of parallel bars being attached at their aft ends to fin 303 and attached at their forward ends to surfboard 301 by pins or nut and bolt fasteners, parallel bars 305, 307, 311, and 313 being housed in parallel recesses in the bottom of the surfboard 301.

Figure 13:
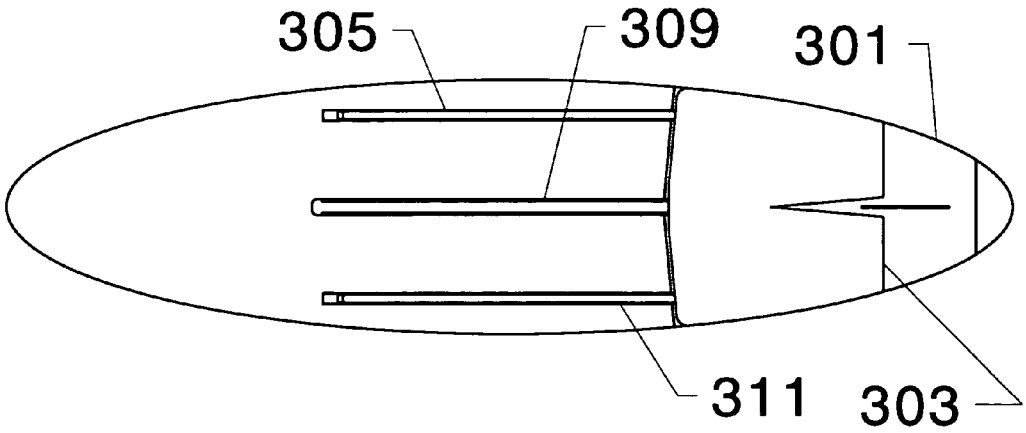

FIG. 13 shows a bottom view of the device of FIG. 12.

Figure 13A:
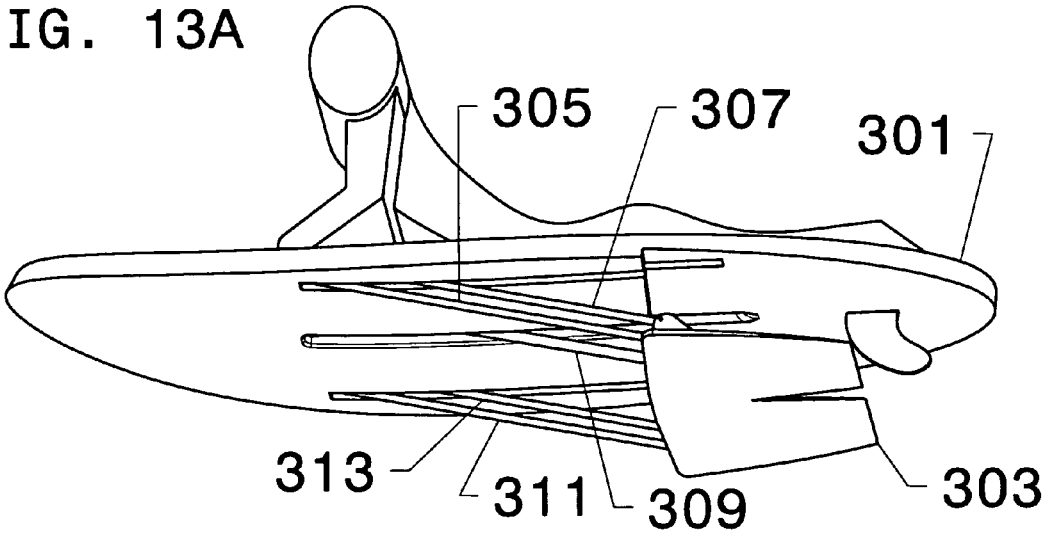

FIG. 13A shows a bottom isometric view of the device of FIG. 12.

Figure 14:
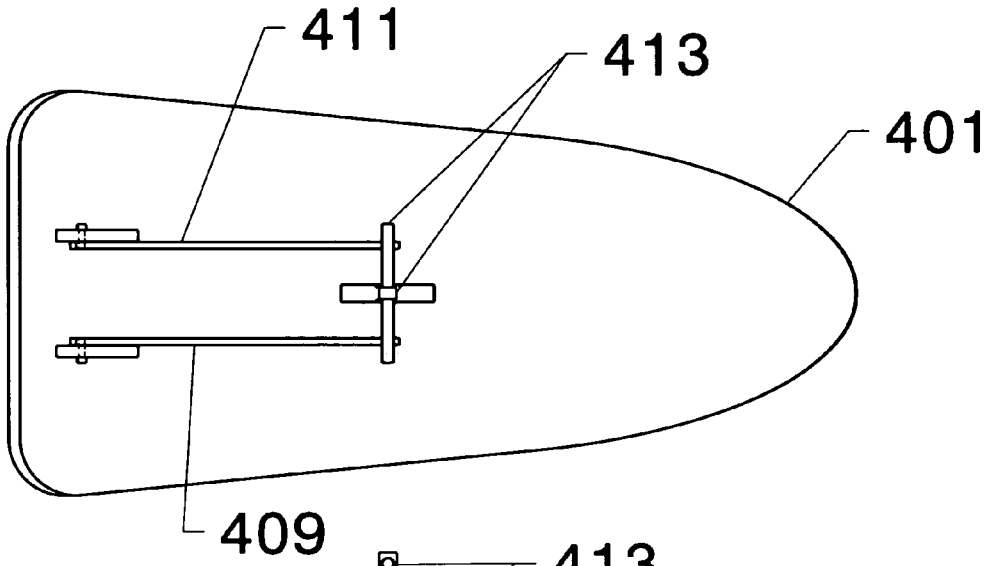

FIG. 14 shows a skim-board 401 with an aperture in the center thereof connecting the bottom surface to the upper surface said aperture housing a graspable down tube 413, down tube 413 being pivotally connected to a fin 403, said fin 403 being pivotally connected to two sets of parallel bars 405 and 407 disposed distally about the longitudinal centerline of the skim-board 401 and below parallel bars 409 and 411 also disposed distally about the centerline of the skim-board 401, said two sets of parallel bars being attached at their aft ends to fin 403 and attached at their forward ends to skim-board 401 by pins or nut and bolt fasteners, parallel bars 405, 407, 409, and 411 being housed in parallel thru the skim-board 401.

Figure 15:
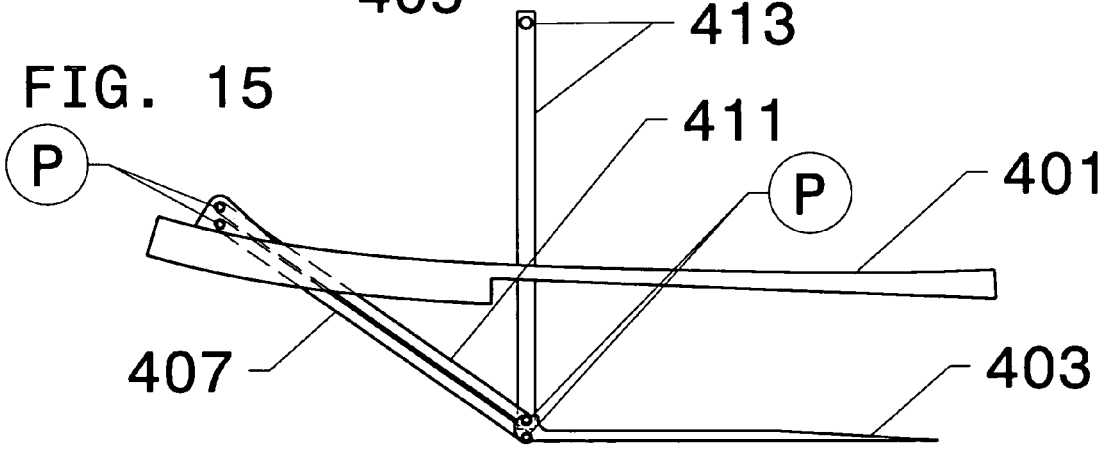

FIG. 15 shows a side view of the device of FIG. 14.

Figure 16:
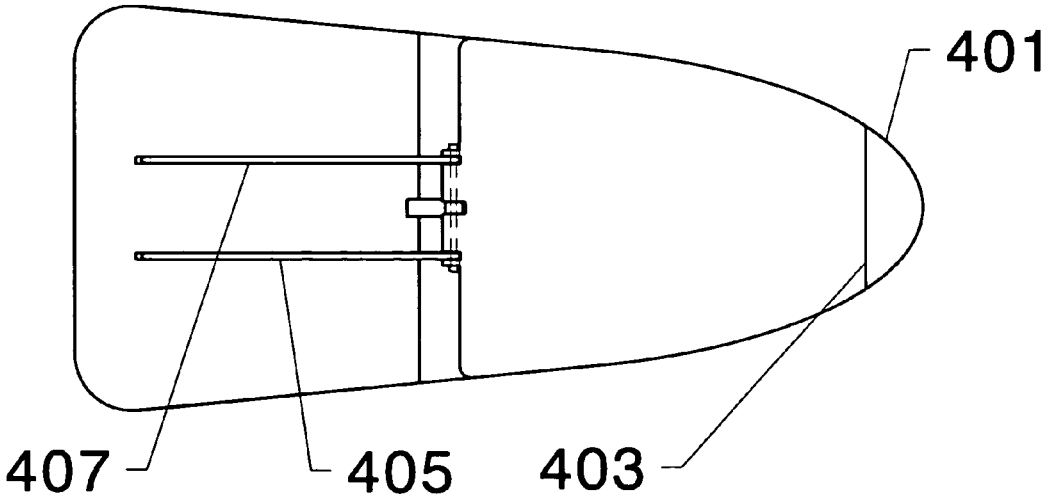

FIG. 16 shows a bottom view of the device of FIGS. 14 and 15.

Figure 17:
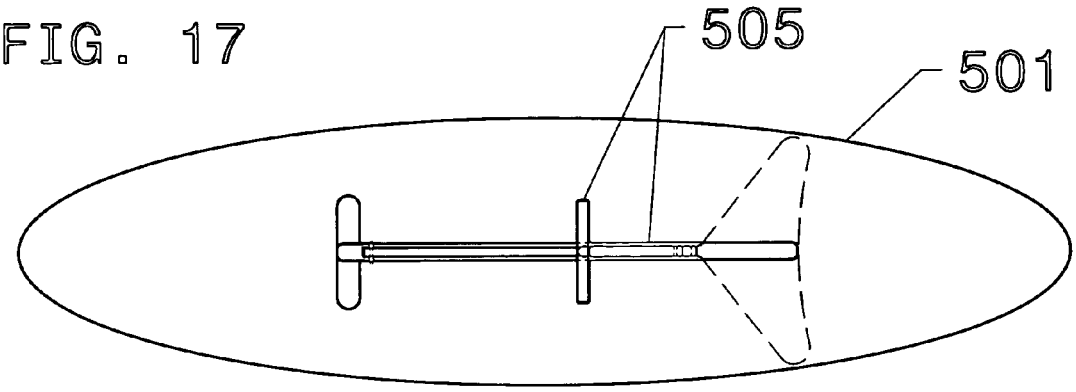
Figure 18:
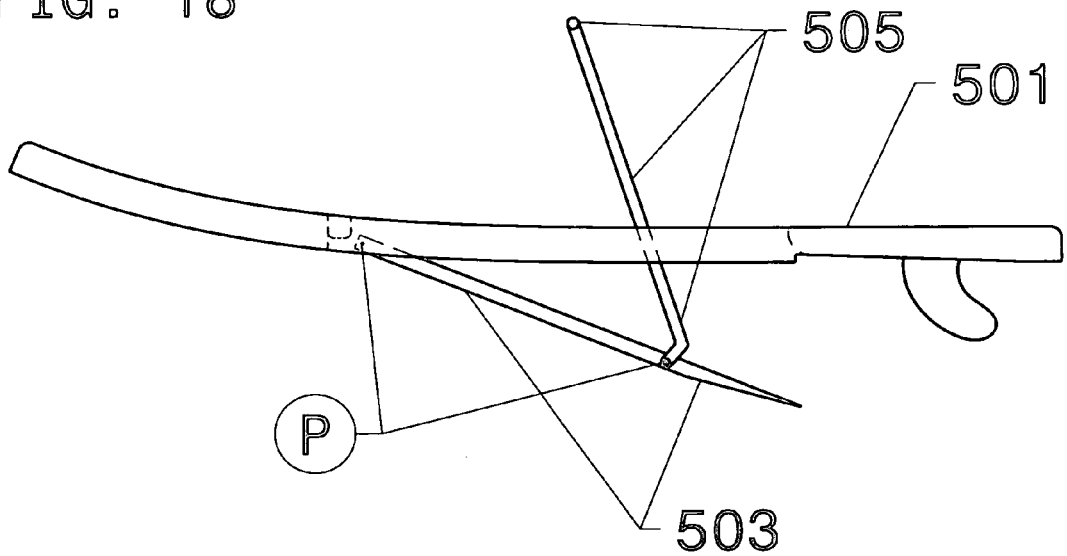
Figure 19:
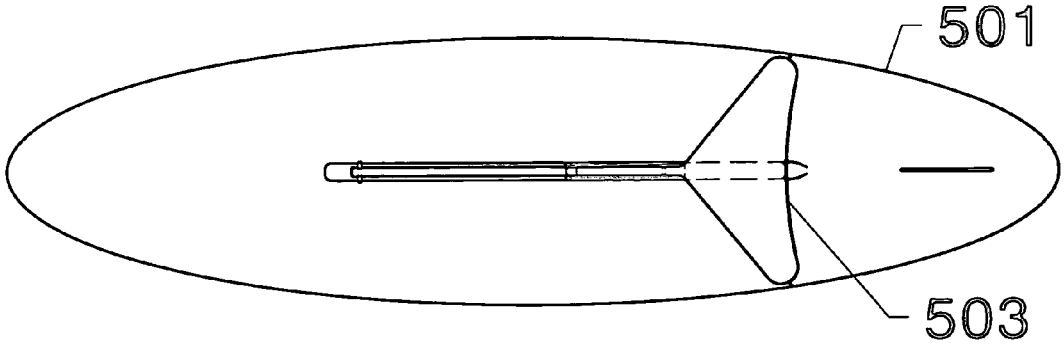

FIGS. 17, 18, and 19 show a surfboard 501 with an aperture connecting the bottom surface to the upper surface of the surfboard, the aperture being substantially in the center of the surfboard, a handled down tube 505 housed within the aperture and pivotally attached to a dagger board fin 503 dagger board fin 503 being housed in a recess in the lower surface of surfboard 501 when dagger board fin 503 is in a non-propelling position, the dagger board fin 503 being attached at a forward end to the surfboard 501 by attachment means such as pins or nut and bolt, the down tube 505 being urged up and down to affect a propelling deflection of the aft fin portion of the dagger board fin 503.

Figure 20:
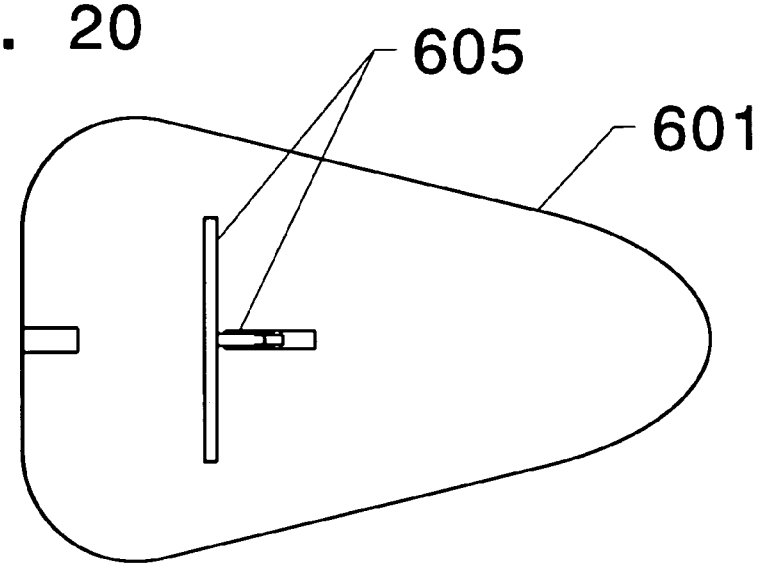
Figure 21:
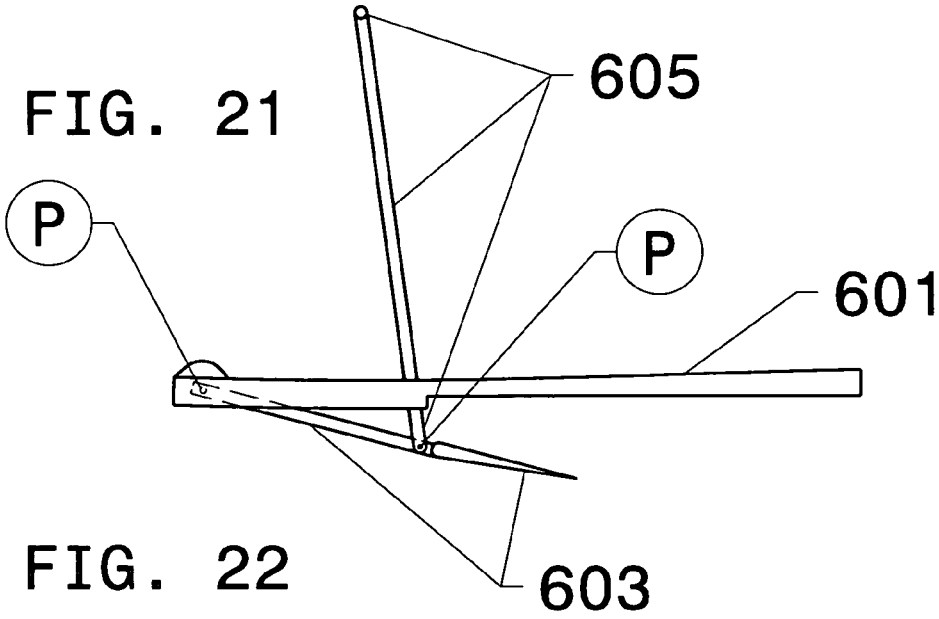

FIG. 20 shows a skim-board 601 with an aperture in the center there of connecting the lower surface to the upper surface and housing a down tube 605, down tube 605 having pivotal connection to a lower member as shown in FIG. 21.

FIG. 21 shows a side view of the device of FIG. 20. The skim board 601 has a recess on a bottom surface to house a fin 603 when said fin is in a non-propelling position, said fin 603 is pivotally connected to down tube 605 at a lower end of down tube 605, at a forward upper end of fin 603, fin 603 having a dagger board like structure at a forward end and being pivotally connected to skim board 601 at a forward end of said dagger board fin 603 at a forward end of skim board 601, skim board 601 having a longitudinal slot in the center there of in a forward position receiving and guiding said dagger board fin 601, attachments between down tube 609 and dagger board fin 603 being made by pins or nut and bolt fastening systems, such that the inventive device may be urged up and downward by a user deflecting said dagger board fin 603 in a propulsive manner.

Figure 22:
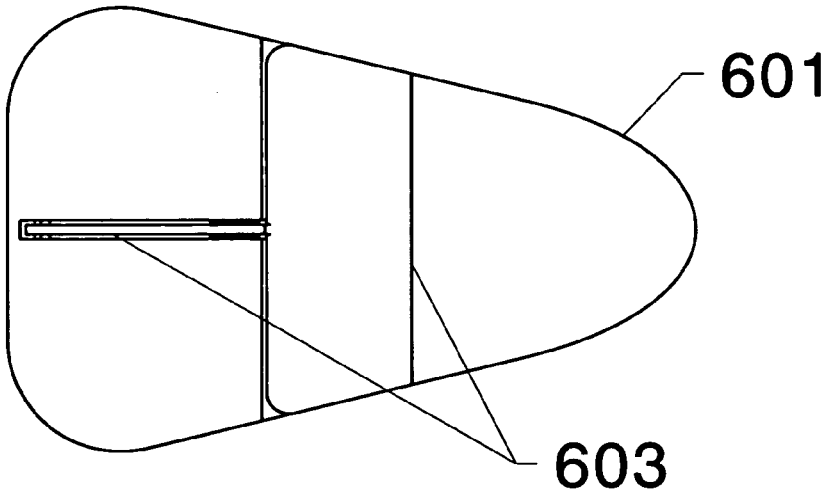

FIG. 22 shows a bottom view of the device of FIGS. 20 and 21 the skim board 601 having a recess in a lower surface to receive and house dagger board fin 603 connected pivotally to the skim board 601 at a forward end of the skim board.

Figure 23:
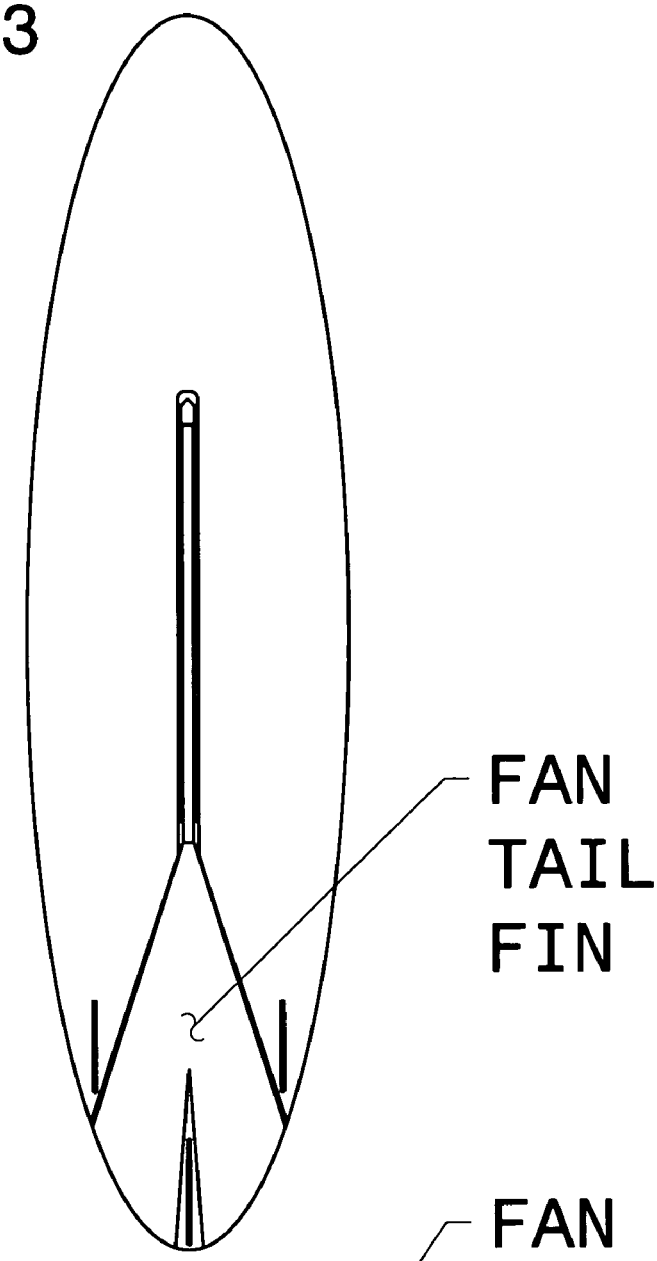
FIGS. 23, 24, 25, 25A and 26 show the claimed invention as an alternate embodiment of fins of various configurations useful to the invention fitted to surfboards.

FIG. 23 shows a surfboard with an alternate embodiment of a propelling fin useful to the devices of this invention. The fin is integrated into a dagger board and has a fan-tail shape.

Figure 24:
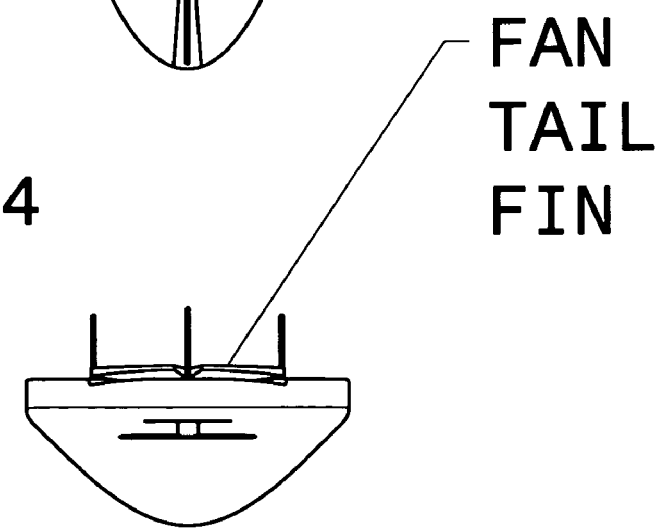

FIG. 24 shows an aft end view of the device of FIG. 23 showing the fan tail fin is shaped to fit within two outboard surfboard fins and around a central surfboard fin, the three surfboard fins making up the classic tri-fin surfboard.

Figure 25:
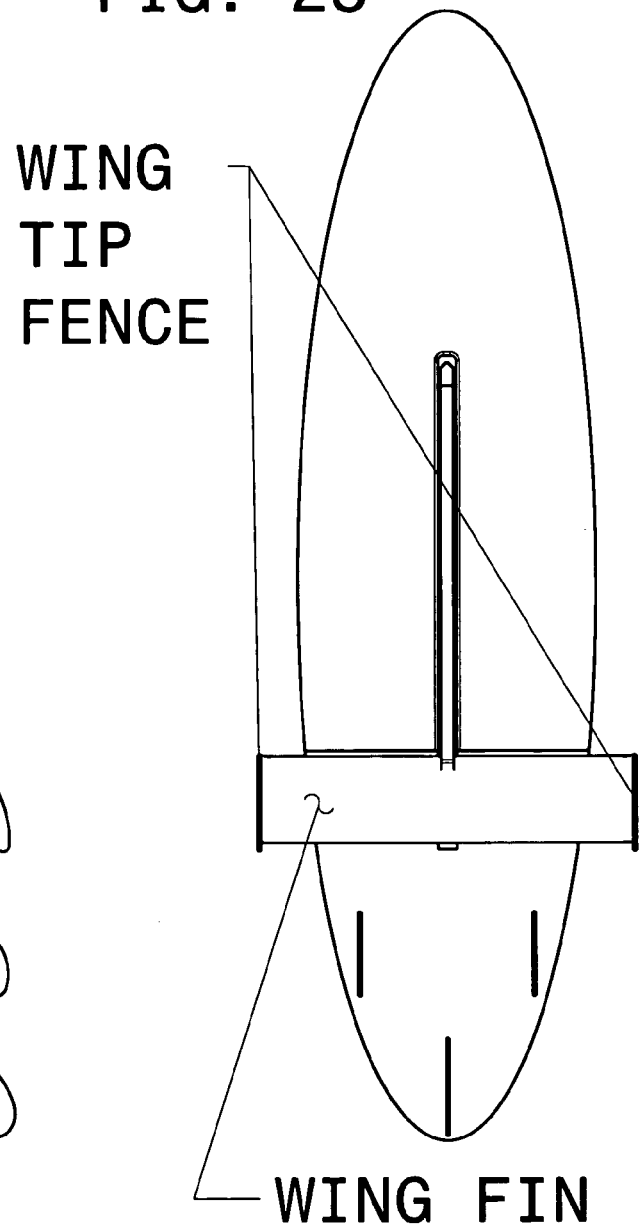
Figure 25A:
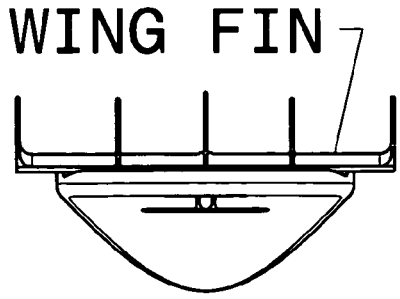

FIG. 25 and FIG. 25A show an alternate embodiment propelling fin in a surfboard wherein the propelling fin is rectangular and wing-shaped having wing tips that may exceed the breadth of the surfboard and having wing-tip fences for wing-tip vortex drag reduction.

Figure 26:
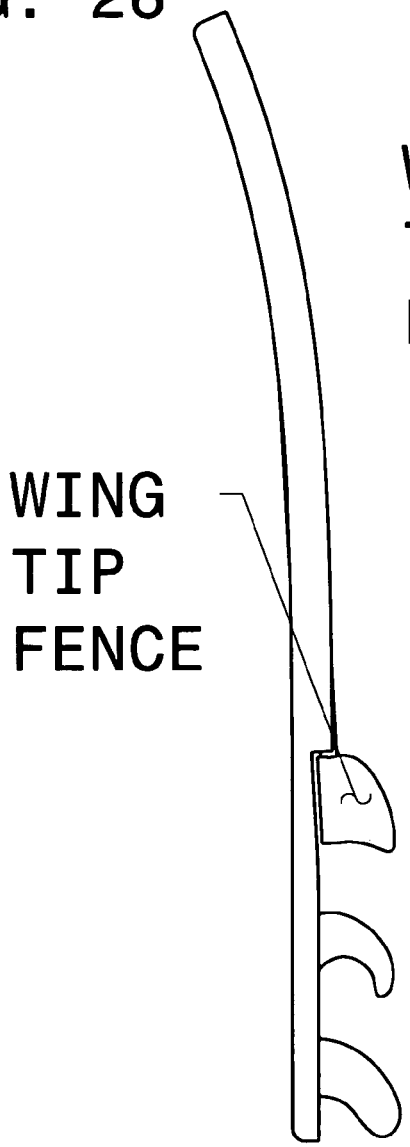

FIG. 26 shows a side view of the device of FIG. 25.

Figure 27:
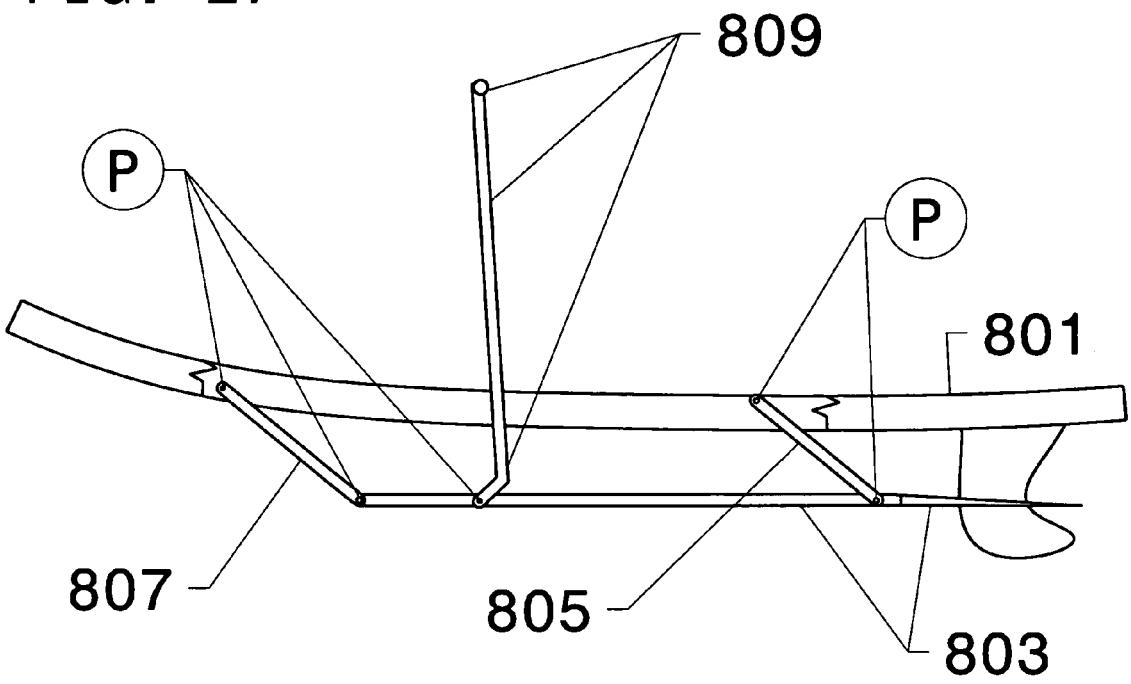
FIG. 27 shows the claimed invention as an alternate embodiment of a four-bar fin-drive system fitted to a surfboard.

FIG. 27 shows a side view of an alternate embodiment four-bar fin-drive device and a surfboard 801 housing parallel bars 805 and 807 connected at respective upper ends tot eh surfboard 801 and at respective lower ends to a fin bar 803 said fin bar 803 having pivotal connection to a graspable down tube 809.

Figure 28:
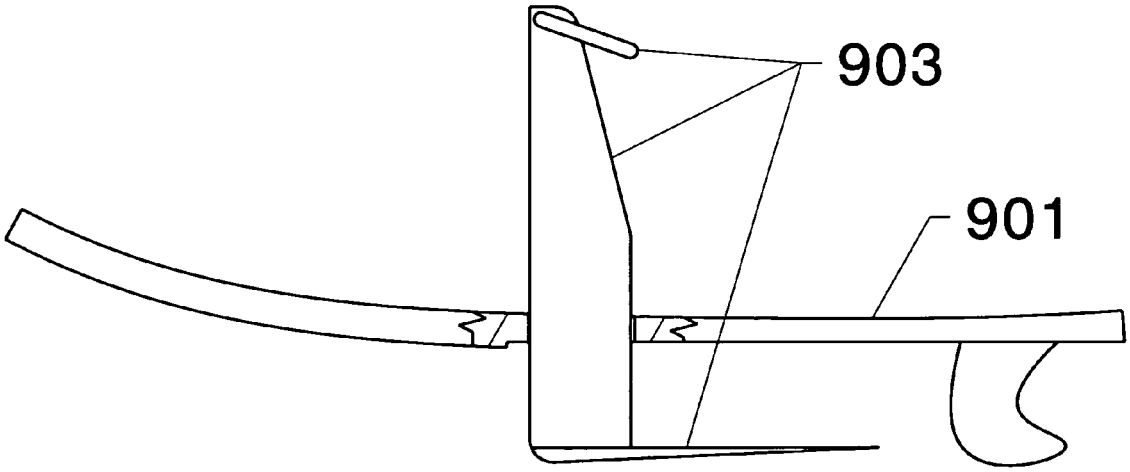
FIG. 28 shows the claimed invention as an alternate embodiment fin drive system fitted to a surfboard.

FIG. 28 shows a surfboard 901 with an aperture in the center thereof connecting the bottom surface to the upper surface and an integrated assembly handled down tube fin drive 903.

Figure 29A:
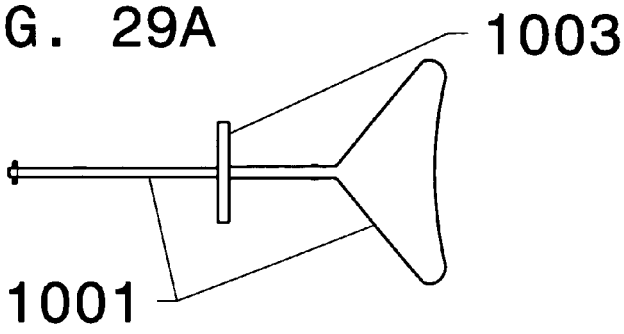
Figure 29:
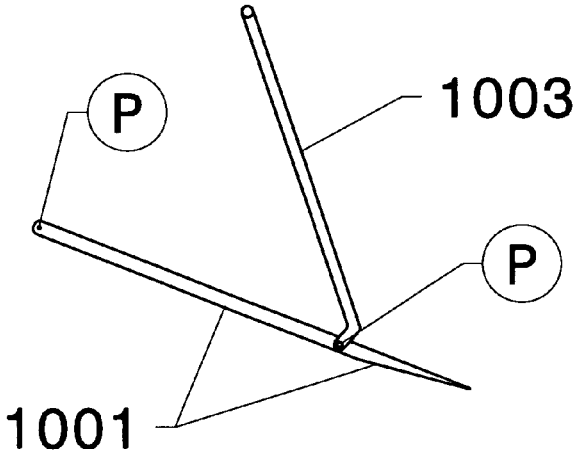
Figure 29B:
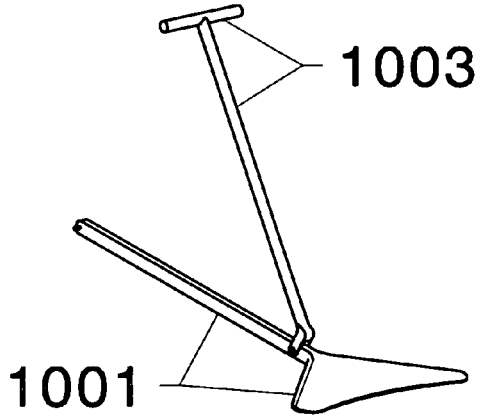

FIGS. 29, 29A, and 29B show a fin-drive assembly made up of a pivotal down tube 1003 connected to a dagger board fin 1001, the dagger board fin being rigid at and forward of a pivot pin connecting said down tube and said dagger board fin and flexible somewhat aft of said connecting pivot pin.

Figure 30:
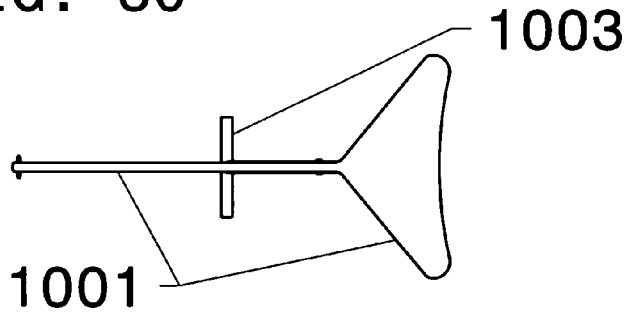

FIG. 30 shows a bottom view of the device of FIG. 29 showing that said dagger board fin aft portion is shaped like a pelagic fin.

FIG. 31 and FIG. 31A show a four bar fin-drive and pivotal down tube device made up of a fin 1101 which is an aft bar of a four bar movement pivotally connected to an upper parallel bar 1105 and a lower parallel bar 1103 at respective aft ends of bars 1103 and 1105, bars 1103 and 1105 being pivotally connected to a forward bar 1107 at their respective forward ends, said fin 1101 being pivotally connected to a down tube 1109 graspable by a user of an aquatic human powered vehicle, the forward bar 1107 having attachment receiver means for attaching the device to a water born vehicle.

FIG. 32 shows a bottom view of the device of FIG. 31.

Figure 33:
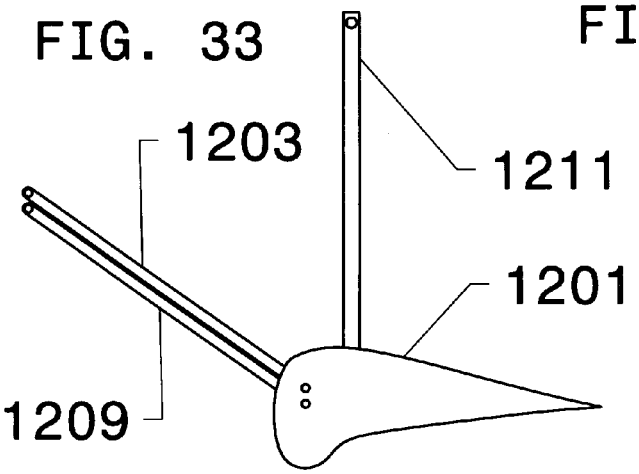
Figure 33A:
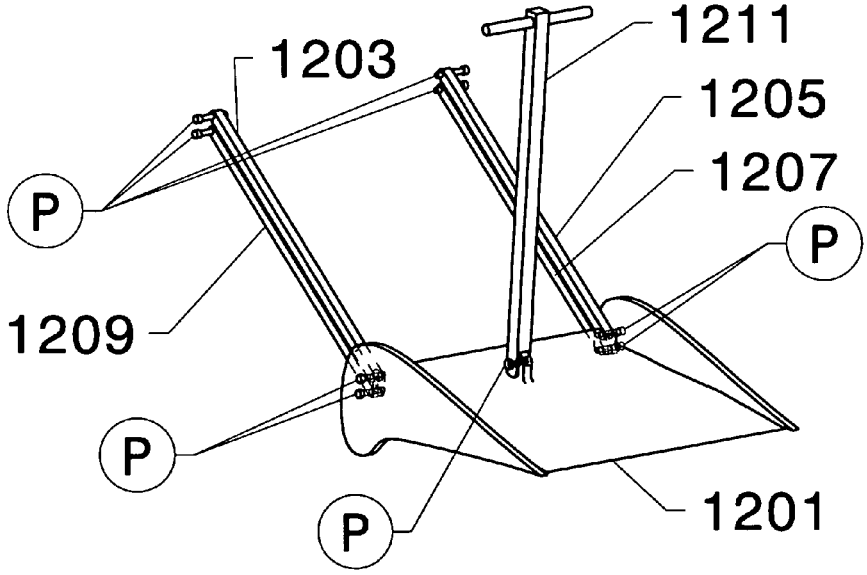

FIG. 33 and FIG. 33A show a fin 1201 with a lug at an upper surface pivotally connecting a down tube 1211 at a lower end of down tube 1211, the fin 1201 being pivotally connected at a forward end to two sets of parallel bars 1203, 1205, 1207, and 1209, parallel bars 1203, 1205, 1207, and 1209 having attachment apertures at a forward end of the said four bars, 1203, 1205, 1207, and 1209 for pivotal attachment to a water borne device and especially for human powered aquatic devices.

Figure 34:
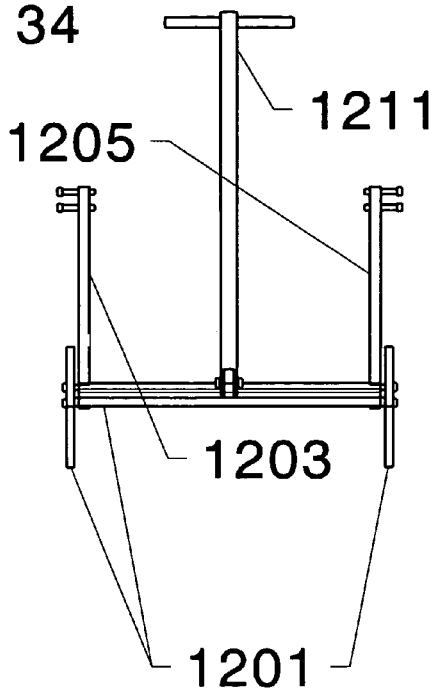

FIG. 34 shows a rear view of the device of FIG. 33 and FIG. 33A.

Figure 35:
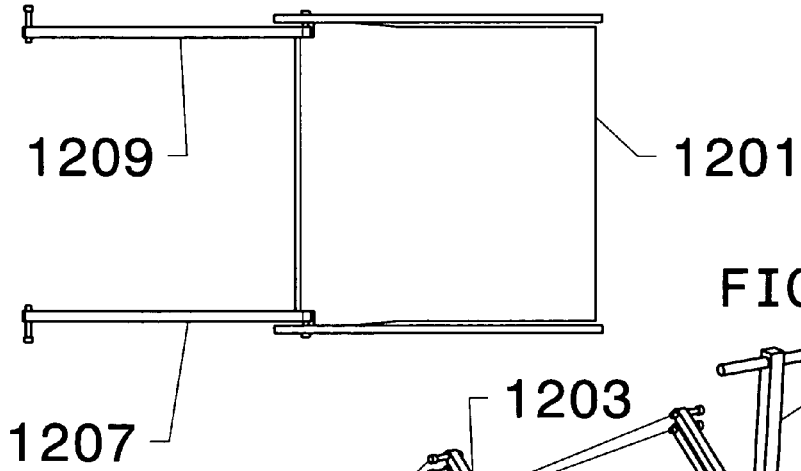

FIG. 35 shows a bottom view of the device of FIGS. 33, 33A and 34.

Figure 36:
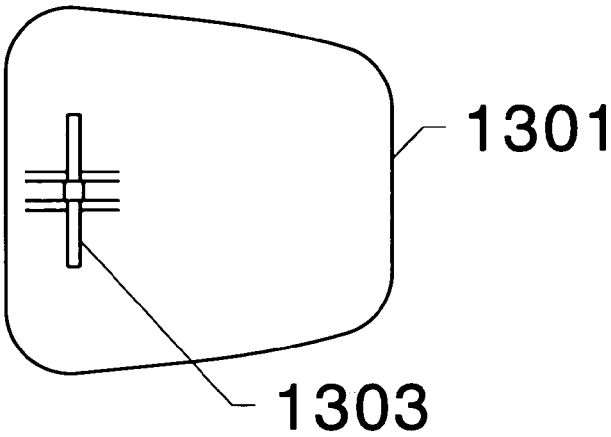
Figure 36A:
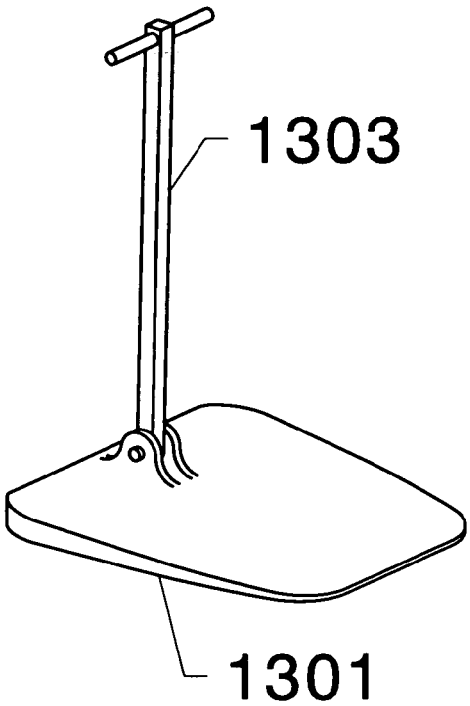

FIG. 36 and FIG. 36A show a skim-board 1301 with a graspable pivotal down tube 1303 the down tube being connected to said skim board by a single pin or nut and bolt type fastener.

Figure 37:
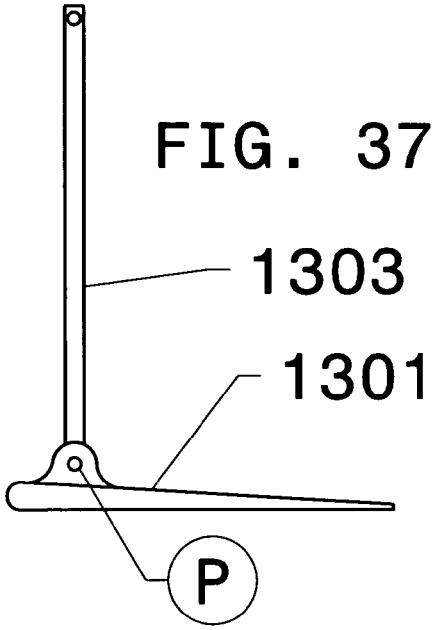

FIG. 37 shows a side view of the device of FIG. 36 and FIG. 36A.

Figure 38:
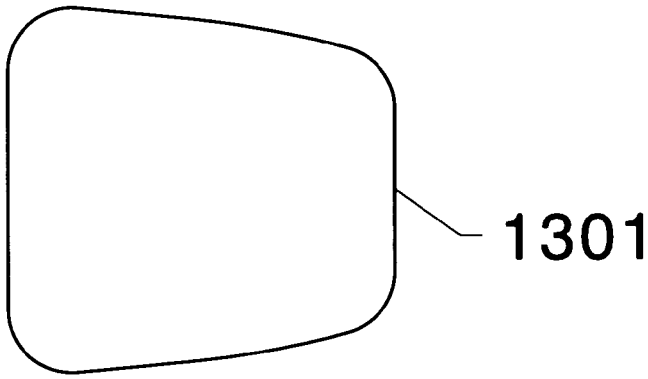

FIG. 38 shows a bottom view of the device of FIGS. 36, 36A, and 37.

While certain features of this invention have been described in detail with respect to the various embodiments thereof, it will be apparent that other modifications may be made within the spirit and scope of this invention and it is not intended to limit the invention to the exact details insofar as they are defined in the following claims. By way of example of modification, the embodiment of FIG. 28 shows a surfboard 901 and a handled fin structure 903 ensconced within an aperture in 901. Connecting 901 and 903 of FIG. 28 with a pivotal rod having a pivot at each end and attaching to 901 and 903 has a salutory affect upon the smoothness of the action of the system and so is intended to be understood as within the spirit and scope of the invention. Also, while the down tube of the invention is variously depicted as attaching to a lower bar or an upper bar of a parallel bar device, and in other depictions to be attached to a fin each is a preferred embodiment further modifiable to allow the down tube to be translated forward and aft by the user and so affecting an adjustment means for accommodating the changes in user position necessitated by different speeds and conditions of the sea. Also, the alternative embodiment of FIG. 27 shows forward and aft parallel bars instead of upper and lower parallel bars with the graspable down tube attaching pivotally along the mid-section of a horizontal fin bar interconnecting pivotally the two parallel bars and attaching at an aft end to a propelling fin. Finally, pontoon boats and catamarans are watercraft that are by their very nature highly adaptable to the invention claimed and are intended to fall within the scope and spirit of the claims.

The invention claimed is:

1. A system for propulsion of an aquatic vehicle having a deck, the system comprising:

an aperture connecting a top surface of the deck to a bottom surface of the vehicle, a bar extending through the aperture and having an upper portion above the vehicle and a lower portion below the vehicle, wherein the lower portion of the bar includes a link, said upper portion of the bar having a portion for grasping;

at least one rod connected to the link, the at least one rod having a first end and a second end; and a fin coupled to said lower portion of said bar, wherein the link is pivotally connected to the fin; and wherein the rod is pivotally connected at the first end to the aquatic vehicle and pivotally connected at the second end to the link.

2. The system of claim 1 wherein the fin is a flexible fin.

3. The system of claim 1 wherein the rod is fixedly connected to the fin.

4. The system of claim 3 wherein the fin is a flexible fin.

5. A surfboard comprising:

a body having a top surface and a bottom surface;

an aperture connecting the top surface and the bottom surface;

a bar projecting through the aperture and extending outwardly from the body, said bar including a bottom end and a top end; and wherein the bottom end of the bar is pivotally fastened to at least one rod, said rod being pivotally fastened at a first rod end to the body and pivotally fastened at a second rod end to a propelling fin; and wherein the body further comprises a recess in the bottom surface of the body configured to receive at least the fin, said recess communicating with said aperture.

6. The surfboard of claim 5 wherein the aperture is located substantially in the center of the body.

7. The surfboard of claim 6 wherein the at least one rod is orientated along the longitudinal axis of the body.

8. The surfboard of claim 7 wherein the at least one rod is positioned above a second rod, the second rod having a first rod end pivotally fastened to the body and a second rod end pivotally fastened to the propelling fin.

9. The surfboard of claim 8 wherein the at least one rod and the second rod further comprises two parallel rods.

10. The surfboard of claim 5 wherein the aperture in the body further comprises:

a space in the bottom of the body configured to receive at least one rod.

11. The surfboard of claim 5 wherein the aperture in the body further comprises:

a space in the top of the body configured to receive the bar.

12. A method for propelling a human powered watercraft having a body, the method comprising:

activating vertical movement on a handle of a bar, the bar extending downwardly through an aperture connecting a top surface of the body and a bottom surface of the body, the bottom end of the bar in communication with at least one rod connected at a first end to the body and at a second end to a fin; and propelling the watercraft.

13. The method of claim 12 further comprising stowing at least a portion of the fin into a recess in the bottom of the watercraft body, said recess communicating with said aperture.

14. The method of claim 12 further comprising stowing at least a portion of the at least one rod into the aperture in the watercraft body.

15. The method of claim 12 further comprising stowing at least a portion of the bar into the aperture in the watercraft body.

16. A skim board comprising:

a body having a top surface and a bottom surface;

an aperture connecting the top surface and the bottom surface;

a bar projecting through the aperture and extending outwardly from the body, said bar including a bottom end and a top end; and wherein the bottom end of the bar is pivotally fastened to at least one rod, said rod being pivotally fastened at a first rod end to the body and at a second rod end pivotally fastened to a propelling fin; and wherein the body further comprises a recess in the bottom surface of the body configured to receive at least the fin, said recess communicating with said aperture.

* * * * *